US006000343A

United States Patent [19]

Laney

[11] Patent Number: 6,000,343

[45] Date of Patent: Dec. 14, 1999

[54] MULTI-CONFIGURATION TABLE

[76] Inventor: Jack W. Laney, 230 E. 15th St. Suite 1-J, New York, N.Y. 10003

[21] Appl. No.: 08/958,056

[22] Filed: Oct. 27, 1997

[51] Int. Cl.[6] ..... A47B 85/00

[52] U.S. Cl. ..... 108/12; 108/65; 108/157.17

[58] Field of Search ..... 108/12, 19, 64, 108/65, 185, 157.17, 153.1

[56] References Cited

U.S. PATENT DOCUMENTS

| | | | |
|---|---|---|---|
| 2,354,106 | 7/1944 | Cooper | 108/12 |
| 2,635,023 | 4/1953 | Frye | 108/12 |
| 2,757,998 | 8/1956 | Adler | 108/12 |
| 3,361,088 | 1/1968 | Hodgkin | 108/12 |
| 3,731,639 | 5/1973 | Schliemann et al. | 108/157.17 |
| 3,744,845 | 7/1973 | Sooker | 108/12 X |
| 4,217,832 | 8/1980 | Pozzan | 108/64 X |
| 4,922,835 | 5/1990 | Van Vliet et al. | 108/185 |
| 5,662,298 | 9/1997 | Collins | 248/188.1 |

FOREIGN PATENT DOCUMENTS

| | | | |
|---|---|---|---|
| 813019 | 5/1937 | France | 108/64 |
| 2546730 | 12/1984 | France | 108/65 |
| 131341 | 4/1951 | Sweden | 108/185 |
| 1769847 | 10/1992 | U.S.S.R. | 108/65 |
| 328488 | 5/1930 | United Kingdom | 108/185 |

OTHER PUBLICATIONS

"A Set of Triple–Use Furniture", Popular Science, pp. 168–169, Apr. 1959.

*Primary Examiner*—Peter M. Cuomo
*Assistant Examiner*—Hanh V. Tran
*Attorney, Agent, or Firm*—Standley & Gilcrest LLP

[57] ABSTRACT

The present invention is a multi-configuration table comprising a table top of four equal-area leaves capable of forming four top variations, and two base portions each having a top side with two cross members, and four legs distending therefrom, so as to define sides thereof, capable of forming several base variations.

8 Claims, 29 Drawing Sheets

MULTI-CONFIGURATION TABLE

TECHNICAL FIELD

The present invention is in the furniture field.

BACKGROUND

The furniture field remains in need of improvement.

It is an object of the present invention to provide a table which is simple to store and form into numerous and widely varied configurations.

It is also an object of the present invention to provide a table which can be stored in a relatively compact configuration which is also functional.

Further it is an object of the present invention to provide a multi-configuration table that can be formed into multiple height, width and depth configurations.

It is also an object of the present invention to provide a multi-configuration table that can be formed into numerous and widely varied configurations without the use of complex fasteners or tools.

In view of the present disclosure or through use of the present invention, other advantages may become apparent.

SUMMARY OF THE INVENTION

The present invention is a multi-configuration table comprising a table top of four equal-area leaves capable of forming four top variations, and two base portions each having a top side with two cross members, and four legs distending therefrom, so as to define sides thereof, capable of forming several base variations.

In general terms, the present invention is a table capable of being configured into at least two surface area sizes and two heights, the table comprising: (a) a table top comprising at least two leaves capable of forming a first and second surface area size configuration; (b) a base comprising a first and second base portion unattached to the table top, the first and second base portion adapted to be arranged in a first and second configuration, the first configuration adapted to support the table top when the two leaves are in the first surface area size configuration, and the second configuration adapted to support the table top when the two leaves are in the second surface area size configuration.

Preferably, the table top comprises four leaves of approximately equal surface area, which may be folded so as to form table top configurations of: (1) the surface area of one of the leaves, (2) the surface area of two of the leaves (folded either end-to-end or side-by-side), and (3) the surface area of all four of the leaves.

The first and second base portions are adapted to be placed so as to provide stable support for the table top in two height settings and without requiring fasteners to hold them to the underside of the table top. The first and second base portions may be adapted to be arranged in a nested configuration and an adjacent configuration, as described in greater detail in the drawings. The first and second base portion may also be adapted to be arranged in a first nested configuration of a first height, a first adjacent, non-nested configuration at the first height, a second nested configuration of a second height, and a second adjacent, non-nested configuration at the second height. Also, the first and second base portion may also be adapted to be arranged in a first nested configuration of a first height, a first adjacent, non-nested configuration at the first height, a second nested configuration of a second height, and a second adjacent, non-nested configuration at the second height, the nested configurations and the adjacent, non-nested configurations capable of supporting the table top configurations of: (1) the surface area of one of the leaves, (2) the surface area of two of the leaves, and (3) the surface area of all four of the leaves.

Preferably, the table of the present invention will have its first and second base portion be identical and each comprising a frame adapted to contact and support a flat surface, and each having four straight legs on one side thereof.

It is also preferred that the first and second base portion are adapted to be arranged in a nested configuration wherein the straight legs of each portion nest toward one another and in an adjacent configuration.

One of the configurations may be one wherein the table top surface area is formed by a first set of two of the leaves, while the remaining two leaves distending from the first set of two of the leaves.

The table leaves may be movably attached to one another through any appropriate mechanical attachment, as described in more detail in the drawings, such as through flush mount hinges, rubber or leather straps, etc.

To extend the length or width of the combined first and second base portions. they may optionally be connected by a removable bridging piece, which may be provided through a mechanical engagement not requiring fasteners.

DETAILED DESCRIPTION OF THE PREFERRED EMBODIMENT

In accordance with the foregoing summary of the invention, the following describes the preferred embodiments of the present invention which are presently considered to be the best mode.

Figure 1A:
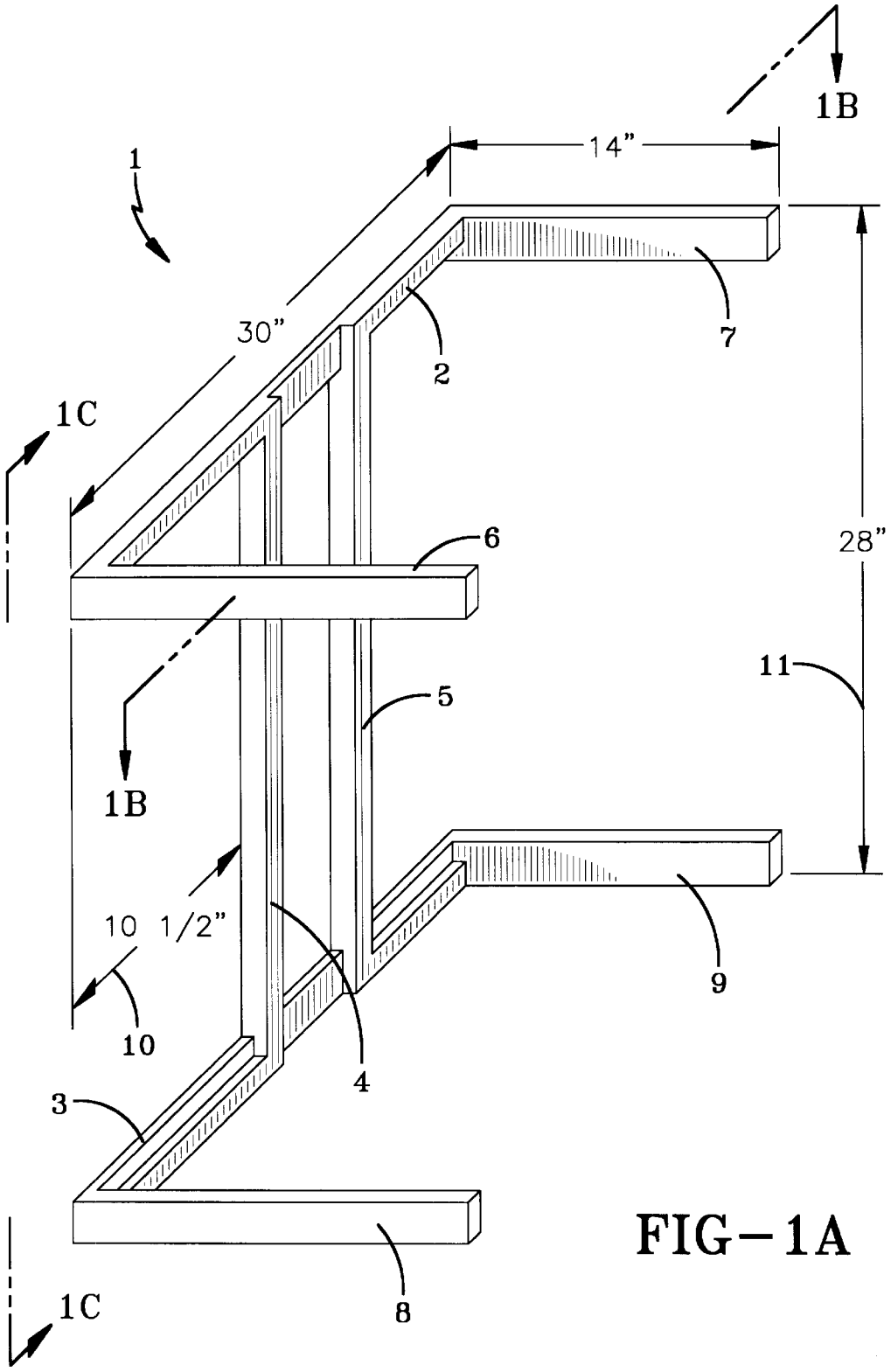
FIG. 1A is a perspective view of a base portion used in accordance with one embodiment of the present invention.

FIG. 1A is a perspective view of a base portion used in accordance with the preferred embodiment of the present invention. FIG. 1A shows main support portion 1 comprising side members 2 and 3 and cross members 4 and 5. Also shown are leg portions 6 and 7 attached to side portion 2 and leg portions 8 and 9 attached to side portion 3. The length of side portions 2 and 3 is approximately 30 inches while the length of the leg portions are approximately 14 inches. Also shown in FIG. 1A is dimension 10 which is 10½ inches while dimension 11 is 28 inches. The cross-section dimensions of the leg portions 6, 7, 8 and 9 are 1.5 inches by 0.5 inches, and the cross-section dimensions of the cross members 4 and 5 are 1.25 inches square. The narrower portions of side numbers 2 and 3 are constructed of 0.75 inch square tubing leaving a 0.75 inch square space alongside these narrower portions.

The base portion may be made out of any dimensionally stable material, such as those known in the furniture making arts. Such materials may include wood, plastics, composite materials such as particle board, natural and manufactured stone materials and metals. The base portion of the embodiment shown in the drawings is made of tubular steel, preferably 16 gauge steel.

Figure 1B:
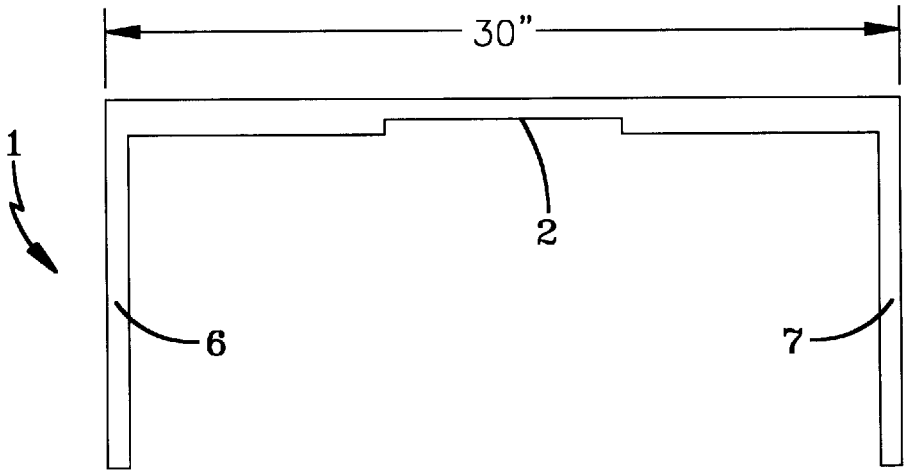
FIG. 1B is an elevational view of a base portion used in accordance with one embodiment of the present invention as viewed along line 1B—1B of FIG. 1A.

FIG. 1B is a view along line 1B—1B of FIG. 1A. FIG. 1B shows side portion 2 and leg portions 6 and 7.

Figure 1C:
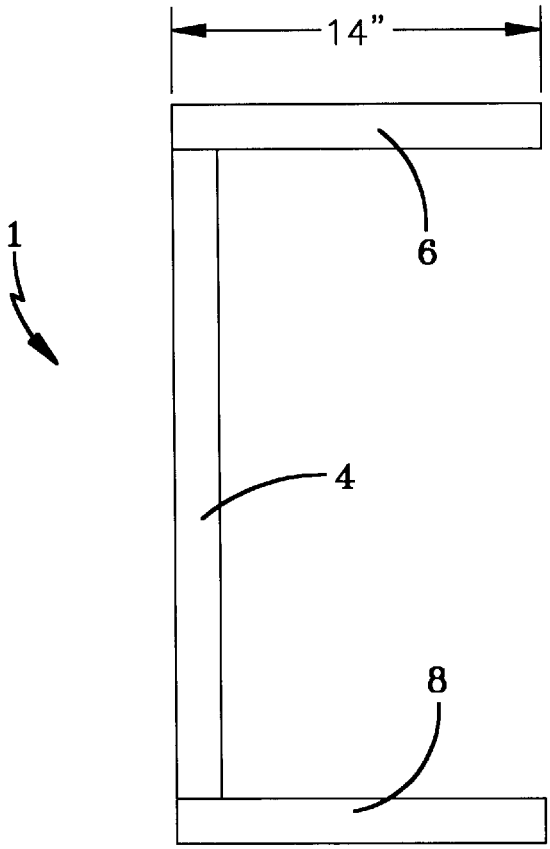
FIG. 1C is an elevational view of a base portion used in accordance with one embodiment of the present invention as viewed along line 1C—1C of FIG. 1A.

FIG. 1C is a view of base portion 1 taken along line 1C—1C of FIG. 1A. FIG. 1C shows cross portion 4 and leg portions 6 and 8.

Two such base portions 1 are used to form the base of the table in accordance with the present invention.

Figure 2A:
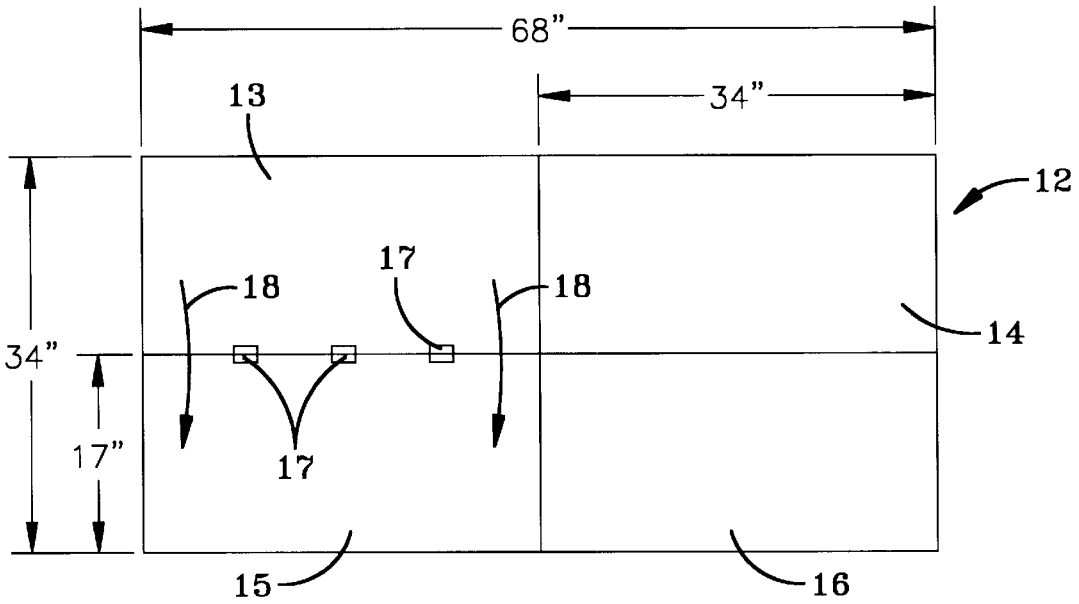
FIG. 2A is a top plan view of a table top used in accordance with one embodiment of the present invention.
Figure 2B:
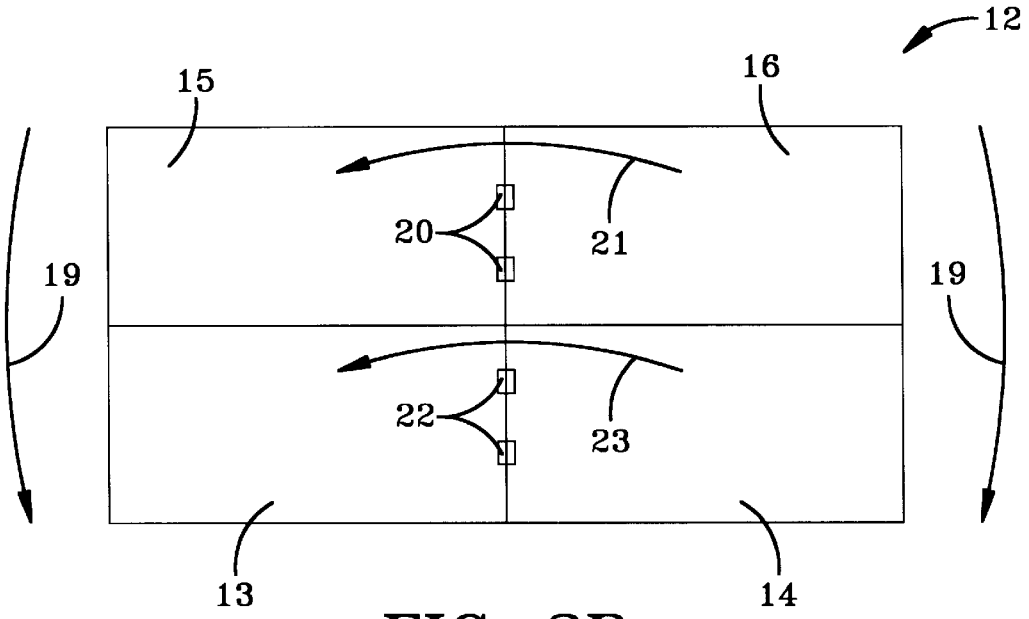
FIG. 2B is a bottom plan view of a table top used in accordance with one embodiment of the present invention.

FIGS. 2A and 2B show a table top used in accordance with the preferred embodiment of the present invention.

FIG. 2A shows table top 12 comprising four separate leaves 13, 14, 15 and 16. Each table leaf 13–16 is preferably twice as long as it is wide, such as having dimensions of 34 inches by 17 inches. FIG. 2A also shows flush mount hinges 17 which allow the table top 12 to be reduced from a total area of 68 inches by 34 inches, to a total area of 68 inches by 17 inches by folding the leaves 13 and 14 atop leaves 15 and 16 along direction arrows 18. The table top leaves are about 0.75 inch in thickness.

FIG. 2B shows the bottom of table top 12 as it would appear if flipped along direction arrows 19 so as to expose the underside of table leaves 13–16. FIG. 2B shows hinges 20 that allow leaf 16 to fold over leaf 15 along direction arrow 21. Likewise, FIG. 2B shows hinges 22 which allow leaf 14 to be folded over leaf 13 as indicated by direction arrow 23. By doing so this changes the overall table dimensions from 68 inches by 34 inches to 34 inches by 34 inches. Folding table leaf 16 underneath table leaf 15 and table leaf 14 under table leaf 13, followed by folding the combination of leaves 15 and 16 and the combination of leaves 14 and 13 by action of hinges 17 allow all four leaves to be folded together so as to form a table top of 34 inches by 17 inches.

Accordingly, the table top 12 shown in FIGS. 2A and 3A is capable of forming four different flat rectangular table tops. Also, rather than folding the combination of leaves 15 and 16 atop the combination of leaves 13 and 14, one two leaf combination can be left to form a 34 by 17 inch table top while the other two leaves may be left to distend from one side of the first two-leaf combination by allowing hinges 17 to swing only 90 degrees along direction arrows 18. Likewise, two of the leaves adjacent on their short sides (such as leaves 13 and 14) can be used to form a table top of 68 inches by 17 inches while the other two leaves (such as leaves 15 and 16), again by allowing flush-mount hinges 17 to swing only 90 degrees along direction arrow 18 can form a side portion distending from the other two leaves forming the table top. It will be noted that the base portion shown in FIGS. 1A–1C can be stood upon its side as shown in FIGS. 1A–1C, or it may be rotated 90 degrees so as to stand upon the ends of leg portions 6–9. These two different orientations allow the base portion to stand at two different heights (i.e., at a height of 28 inches when on its side and at a height of 14 inches while standing on the leg ends.) Another base portion identical to that shown in FIGS. 1A–1C can be placed in various orientations with respect to one another, as shown in the subsequent Figures.

Figure 3:
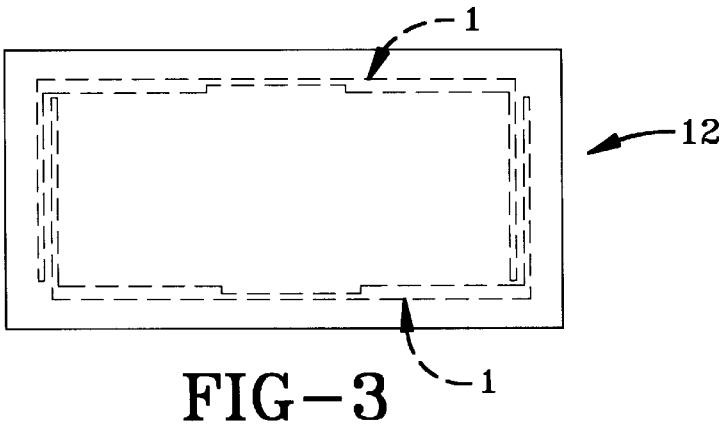
FIG. 3 is a top plan view of a table configuration in accordance with one embodiment of the present invention.

FIG. 3 shows a top plan view of a table in accordance with one embodiment of the present invention showing table top 12 configured so as to produce a table top area equal to that of one of the leaves described above (i.e., 34 inches by 17 inches). FIG. 3 shows table top 12 as though transparent so that two base portions 1 are shown in a side-resting configuration (as shown in FIG. 1A) with the leg portions of each nested into one another and facing one another such that the overall dimension of the base formed by the two base portions is approximately 30 inches by 14 inches. This configuration may be used for instance as a side table. This configuration has a total height of approximately 31 inches.

Figure 4:
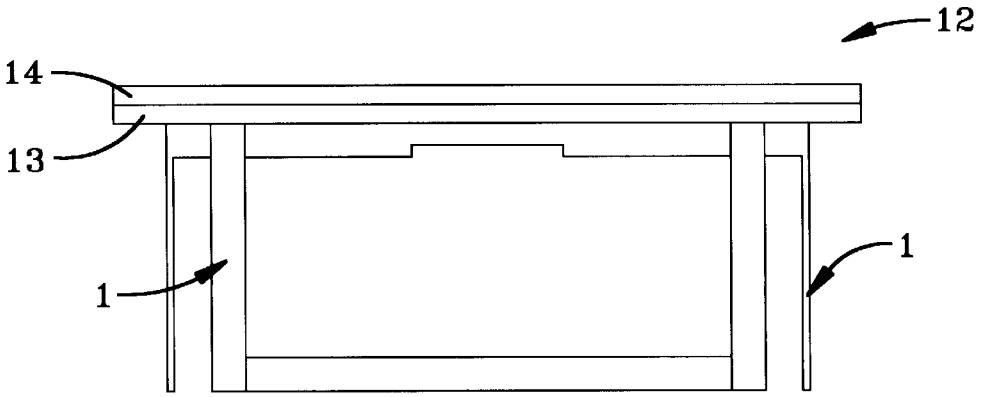
FIG. 4 is a side elevational view of a table configuration in accordance with one embodiment of the present invention.

FIG. 4 is a side elevation view of another table configuration showing table top 12 in an intermediate sized configuration as described above (i.e., 34 inches by 34 inches). In this configuration, the base is formed by the two base portions 1 being in a nested configuration but with one base portion having its leg portions oriented upward while the other base portion is oriented with its leg portions downward. Such a configuration forms a base of approximately 30 inches by 27 inches with a height of approximately 14 inches. Such a configuration may be used as a coffee table.

Figure 5:
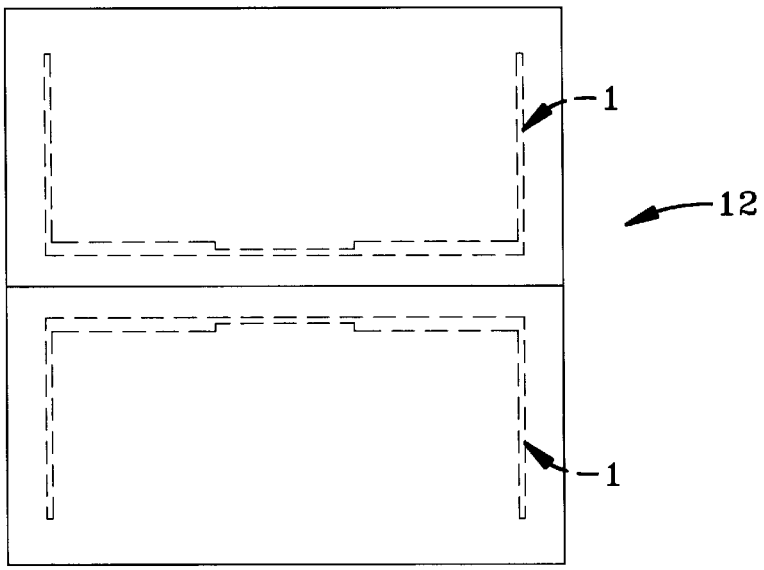
FIG. 5 is a top plan view of a table configuration in accordance with one embodiment of the present invention.

FIG. 5 is a top plan portion of yet another table configuration in accordance with the preferred embodiment of the present invention. FIG. 5 shows table top 12 and the intermediate sized configuration as described above (i.e., 34 inches by 34 inches). In this configuration the two base portions 1, seen as though table top 12 were transparent, are placed in a configuration such as to rest on their side as shown in FIG. 1A but with the leg portions pointing in opposite directions. Such a configuration forms a base portion of approximately 30 inches by 28 inches (the latter dimension being approximately twice that of the length of the leg portion). This gives an overall total height of approximately 29.5 inches. This configuration may be used, for instance as a card table to seat four persons.

Figure 6:
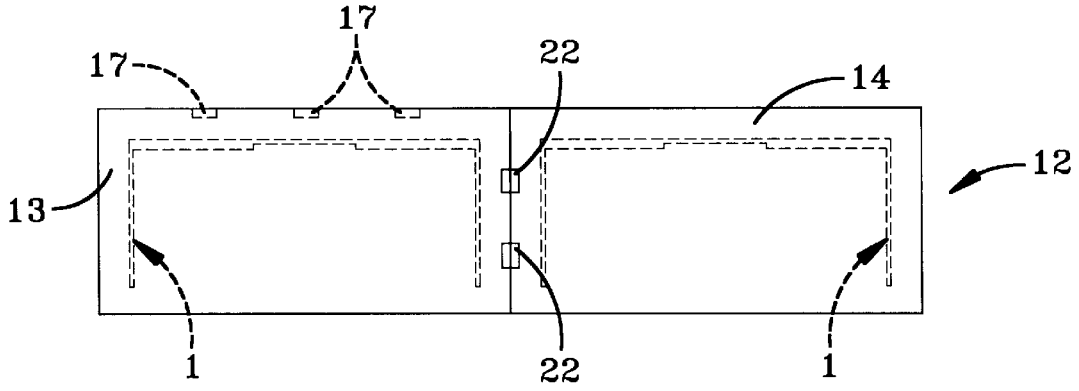
FIG. 6 is a top plan view of a table configuration in accordance with one embodiment of the present invention.

FIG. 6 shows yet another configuration of the table of the preferred embodiment of the present invention. FIG. 6 shows table top 12 in a relatively long and narrow configuration (i.e., 68 inches by 17 inches as described above). In this configuration, the two base portions are in the side-rested position but are adjacent along their narrow sides (i.e., along their leg portion sides). This allows the base thus formed to have an overall dimension of approximately 60 inches by 14 inches, as can be seen by adjacent base portions 1 as would be viewed through table top 12, if transparent. Such a configuration may be used for instance as a buffet or as a partner desk (the latter by rotating one base portion 180 degrees about the vertical axis). Also visible in FIG. 6 are hinges 22 adjoining, in this case, leaves 13 and 14 also shown as the position of hinges 17 although they would not be visible in this configuration.

Figure 7:
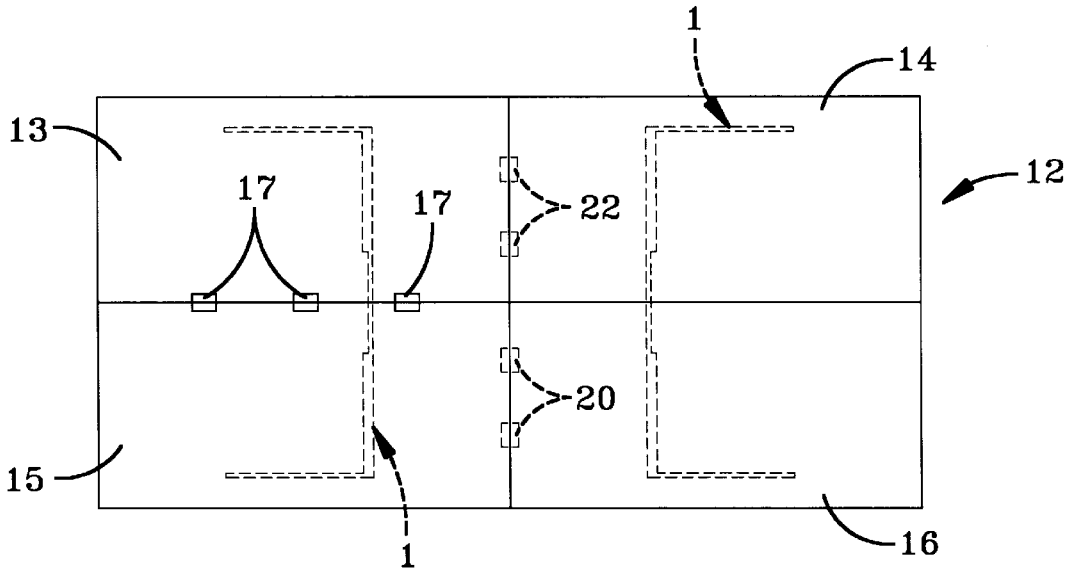
FIG. 7 is a top plan view of a table configuration in accordance with one embodiment of the present invention.

FIG. 7 shows still another configuration of the table in accordance with the present invention. FIG. 7 is a top plan view showing table top 12 comprising leaves 1'3–16 adjoined by hinges 17, 20 and 22 as described above. The base portions 1 are visible as though table top 12 were transparent. FIG. 7 shows that the base portions 1 are positioned adjacent one another with the leg portions of each facing away from one another. The base portions are placed some distance apart so as to support table top 12 which, as shown, is in its greatest area configuration (i.e., 68 inches by 34 inches). Such a configuration may be used for a dining table to seat 6 persons. The table has an overall height of approximately 28.75 inches.

Figure 8:
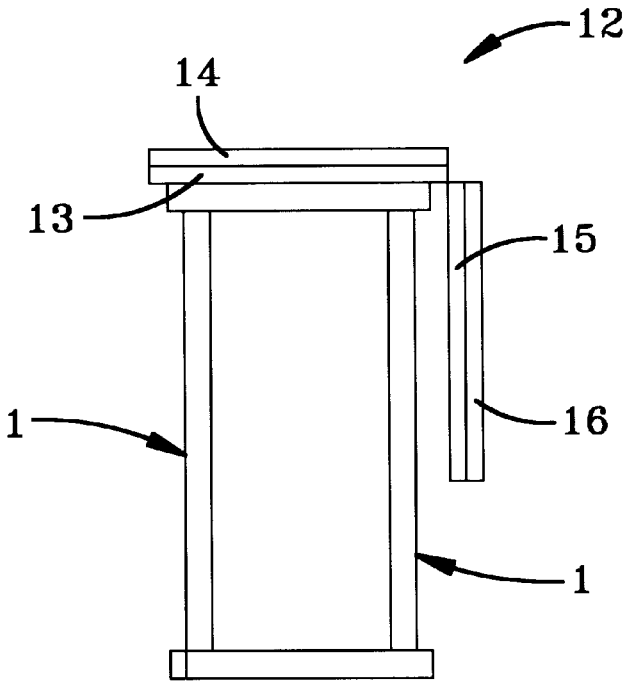
FIG. 8 is a side elevational view of a table configuration in accordance with one embodiment of the present invention.

FIG. 8 is a side elevation view of yet another configuration of the table of the present invention. FIG. 8 shows a configuration similar to that of FIG. 3 except that a portion of table top 12 (i.e. comprising leaves 13 and 14) forms the top of the table while another portion comprising leaves 15 and 16 distend from the side of the table top so formed.

Figure 9:
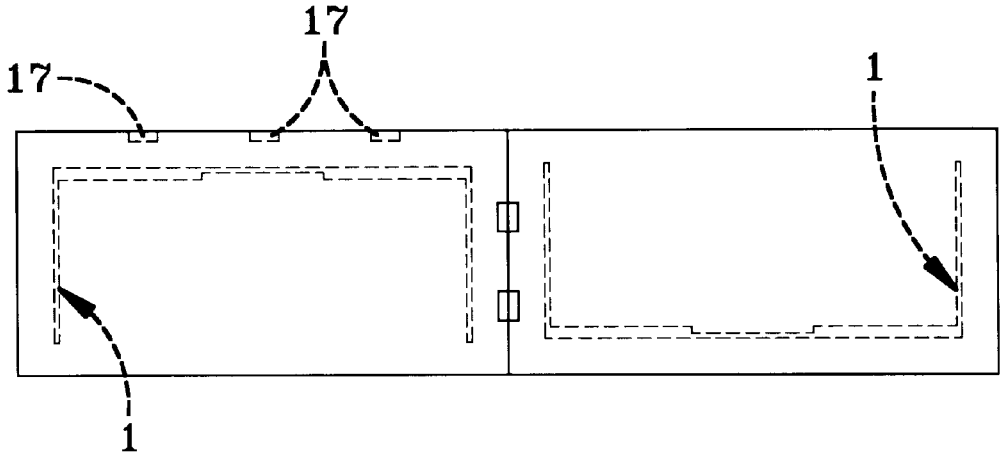
FIG. 9 is a top plan view of a table configuration in accordance with one embodiment of the present invention.

FIG. 9 shows a configuration which is an alternative to FIG. 6 described above, wherein one of the base portions 1 has been rotated 180 degrees about its vertical axis.

Figure 10:
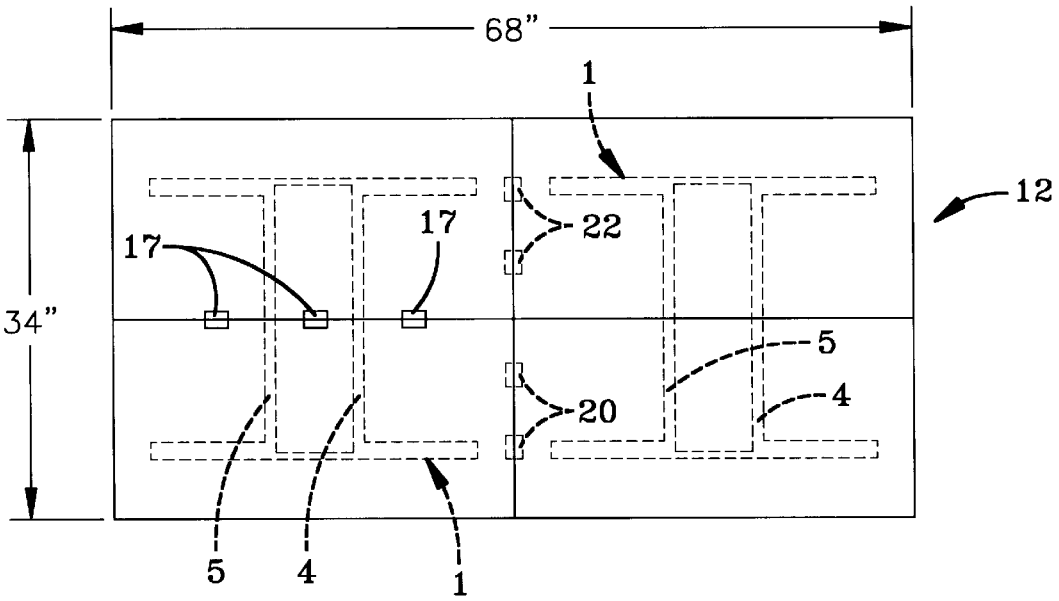
FIG. 10 is a top plan view of a table configuration in accordance with one embodiment of the present invention.

FIG. 10 shows yet another configuration of a table in accordance with one embodiment of the present invention. This configuration is for a table of large area and relatively short height (i.e., approximately 15½ inches). FIG. 10 shows base portions supporting table top 12 as they would be seen if the table top were transparent. Also seen in FIG. 10 are hinges 20, 22 and 17. The base portions 1 may be oriented side by side as shown in FIG. 10 with the cross members 4 and 5 of each support portion 1 are lined perpendicular to the longitudinal axis of the table top 12. As can be appreciated from the dimensions of the base portions 1, the base portions might also be aligned so as to align the cross members 4 and 5 parallel to the longitudinal axis of the table top 12. Also one could align the base portions such that the cross members 4 and 5 of one base portion are perpendicular to the cross portions 4 and 5 of the other base portion.

Figure 11:
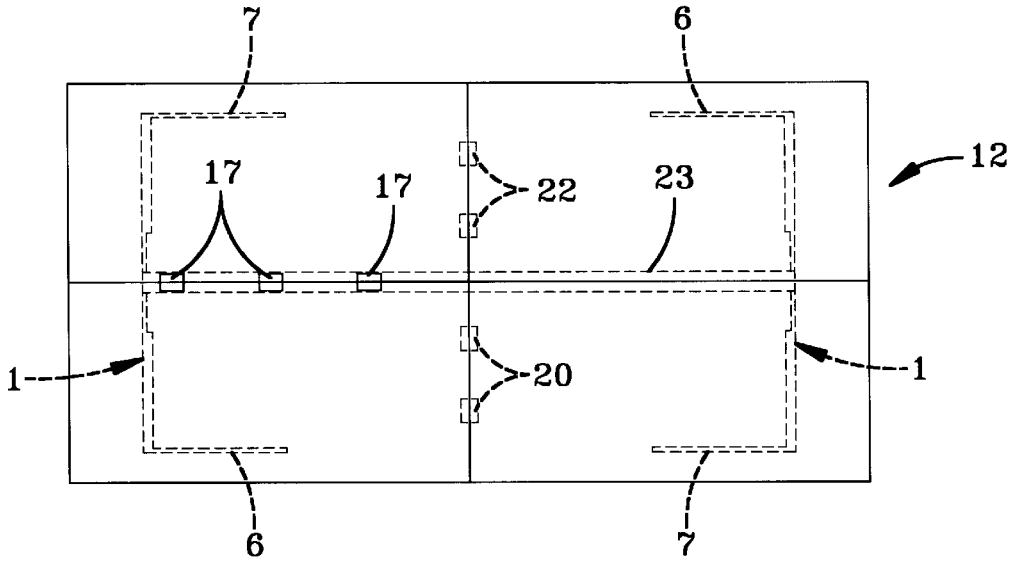
FIG. 11 is a top plan view of a table configuration in accordance with one embodiment of the present invention.
Figure 11A:
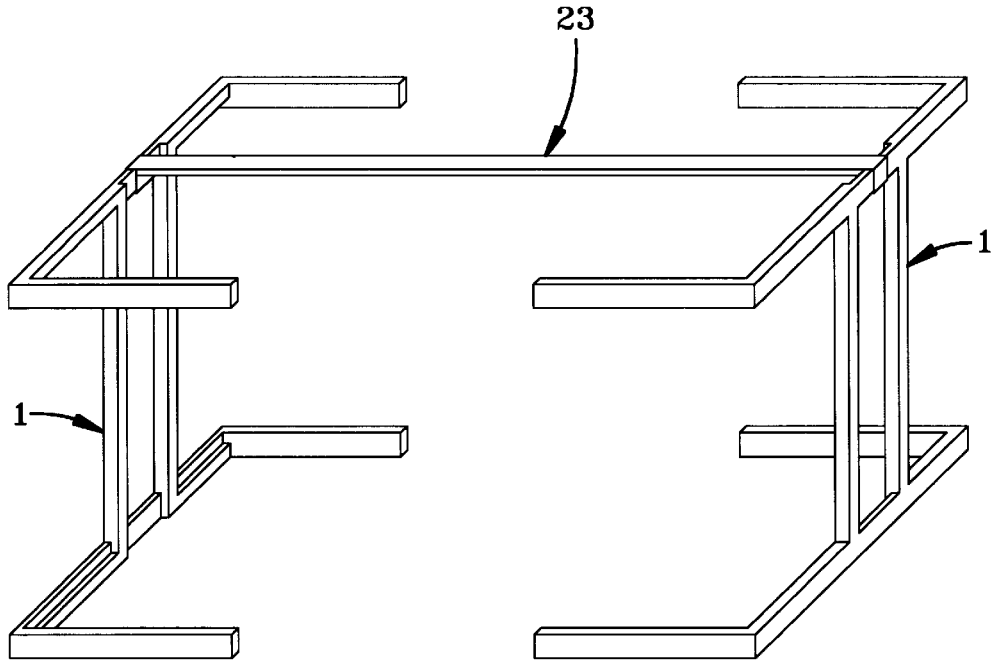
FIG. 11*a* is a perspective view of the base of the table configuration shown in FIG. 11.
Figure 11B:
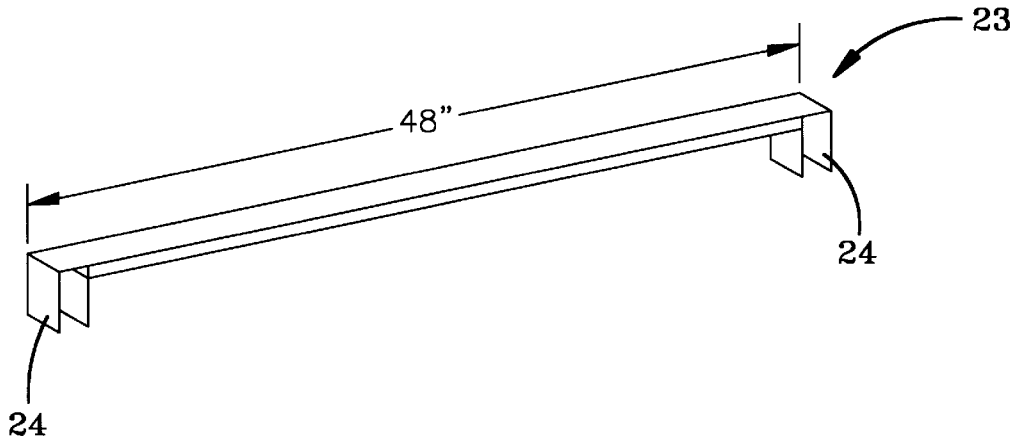
FIG. 11*b* is a detailed perspective view of the bridge member used in the base of the table configuration shown in FIG. 11.

FIG. 11 shows yet another configuration of the table of the present invention. FIG. 11 shows table top 12 supported by the two base portions 1 which are positioned such that the ends of the leg portions of each (6 and 7 respectively) are directed toward one another. This configuration is very similar to that shown in FIG. 1 with the exception of the orientation of the base portions and the fact that base portions are connected via optional bridge portion 23 for additional support. The base configuration of the configuration of FIG. 11 is shown in more detail in FIG. 11*b* which shows identical base portions 1 connected via bridge portion 23 which is shown in more detail in FIG. 11*b*. FIG. 11*b* shows bridge portion 23 which is in the form of a member having shaped fittings 24 on either end which are adapted to engage, in saddle fashion, the cross members to each of the base portions 1 as shown in FIG. 11*a*. A typical dimension for such a bridging member 23 for use in the shown embodiment is a length of 48 inches with dimensions of 2 inches by ¾ inches. The fittings 24 as shown have a spread of about 1 inch with the opening extending 2 inches in height. It is preferred that the fittings 24 be as thin as practicable. The bridging member 23 adds support to the table top when completely open.

Figure 12:
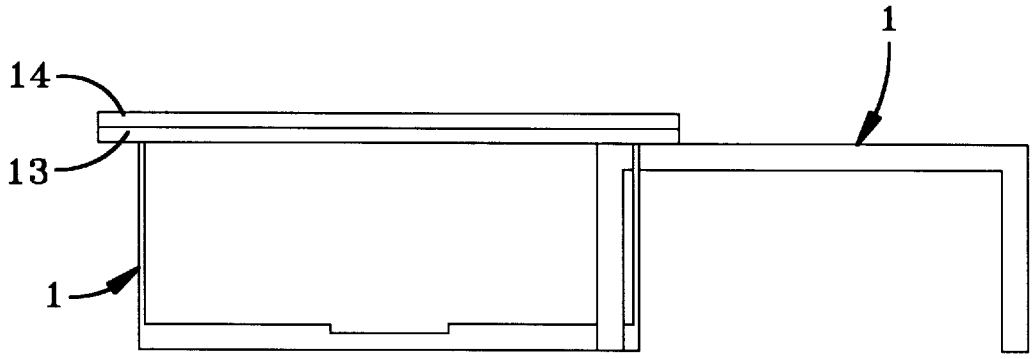
FIG. 12 is a side elevational view of a table configuration in accordance with one embodiment of the present invention.

FIG. 12 is a side elevational view of yet another configuration of the table of the present invention. FIG. 12 shows the table top 12 in the intermediate side configuration as described above (i.e., 34 inches by 34 inches). In this configuration the two base portions 1 are placed in a side-by-side configuration such that the table top 12 is centered upon one of the base portions (the "supporting base portion"), the table top being supported by the upward-extending legs of one base portion; the parallel cross-members extending along the floor surface. The other base portion resides to one side of the supporting base portion, and rests on its legs, with its cross-members extending perpendicular to those of the supporting base portion. The adjacent pairs of legs of each respective base portion are able to be slightly nested. The cross-members of the other base portion may be used to hold items such as might be placed in lipped containers having lipped edges that engage the cross-members such that the container(s) extend(s) below the plane of the cross-members. Such a configuration forms a supporting base portion of approximately 30 inches by 28 inches. This configuration gives an overall total height of approximately 15.5 inches. This configuration may be used, for instance, as a coffee table or oriental dining table, with a service function, such as for nuts, potato chips, pretzels, condiments or sushi.

Figure 13:
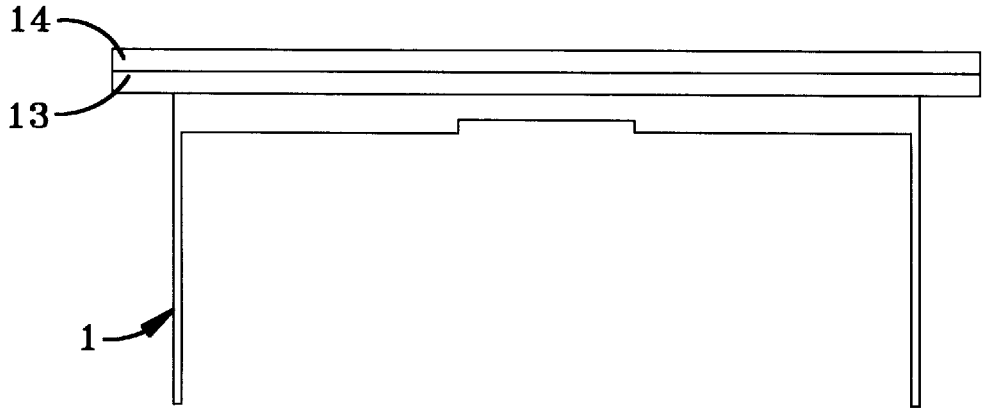
FIG. 13 is a side elevational view of a table configuration in accordance with one embodiment of the present invention.

FIG. 13 is a side elevational view of yet another configuration of the table of the present invention. FIG. 13 shows the table top 12 in the intermediate side configuration as described above (i.e., 34 inches by 34 inches). In this configuration the table top 12 is centered upon only one of the base portions. The base portion rests on its legs. Such a configuration forms a supporting base portion of approximately 30 inches by 28 inches. This configuration gives an overall total height of approximately 15.5 inches. This configuration may be used as a coffee table or oriental dining table.

The dimensions of the base portions may be selected for the desired size of the table configurations to be produced. Most preferred is to have the leg sides be about 14 inches long with the dimension parallel to the cross members being 28 inches and the dimension parallel to the cross members being 30 inches; which affords the most number of commonly applicable table heights with proper stable support.

Figure 14:
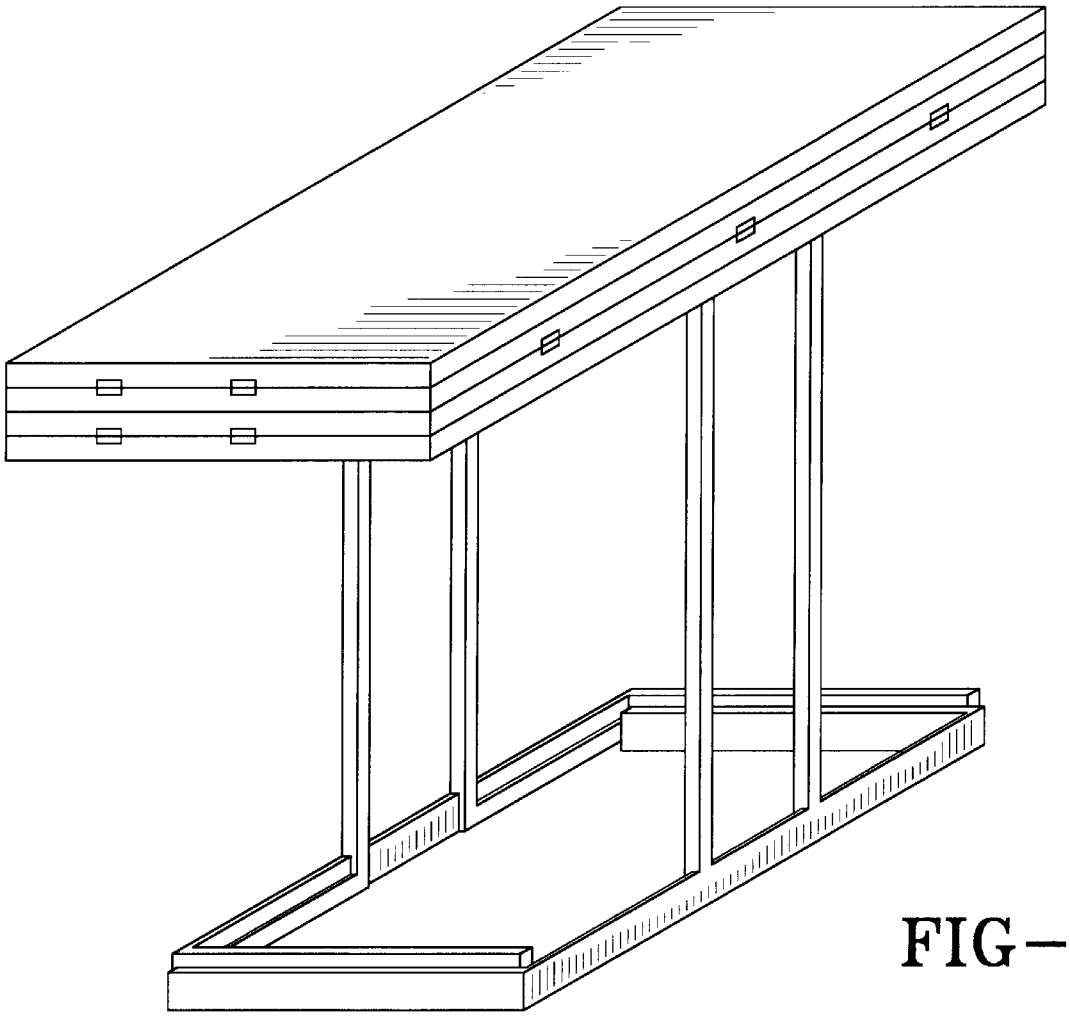
FIG. 14 is a perspective view of a table configuration in accordance with one embodiment of the present invention.
Figure 14B:
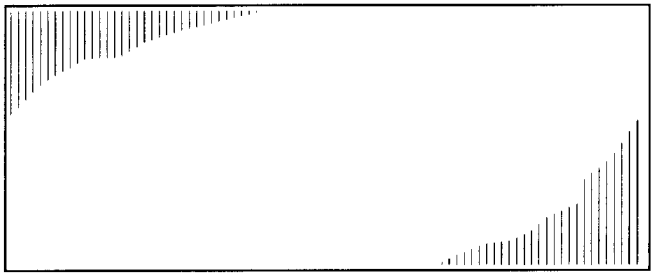
FIG. 14*b* is a top plan view of the table of FIG. 14.
Figure 14D:
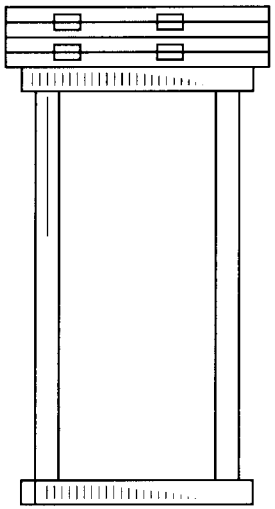
FIG. 14*d* is a front view of the table of FIG. 14.
Figure 14A:
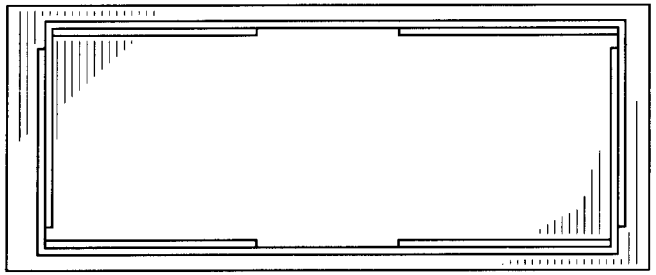
FIG. 14*a* is a bottom plan view of the table of FIG. 14.
Figure 14C:
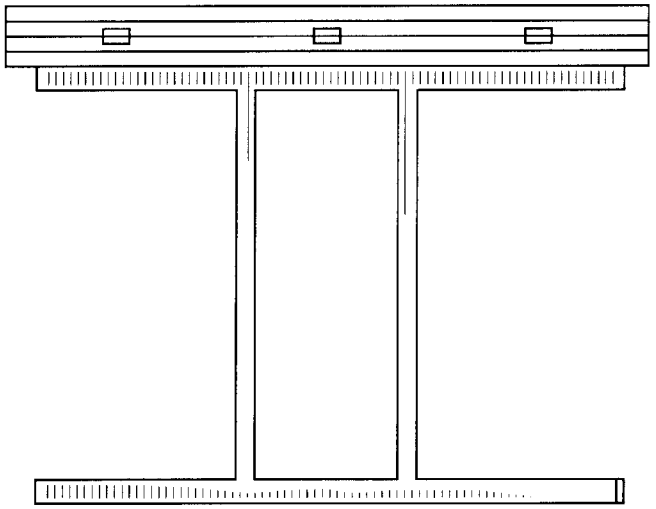
FIG. 14*c* is a side plan view of the table of FIG. 14.

FIG. 14 is a perspective view of the table of the present invention in an alternative configuration (as described in FIG. 3) wherein the top of the table is in a configuration wherein the top is formed from all four of the leaves are arranged atop one another; and wherein the base is formed from the two base portions being in a nested configuration and forming a base of a relatively tall height. FIG. 14*a* is a top plan view of the table of FIG. 14. FIG. 14*b* is a bottom plan view of the table of FIG. 14. FIG. 14*c* is a side plan view of the table of FIG. 14. FIG. 14*d* is a front view of the table of FIG. 14.

Figure 15:
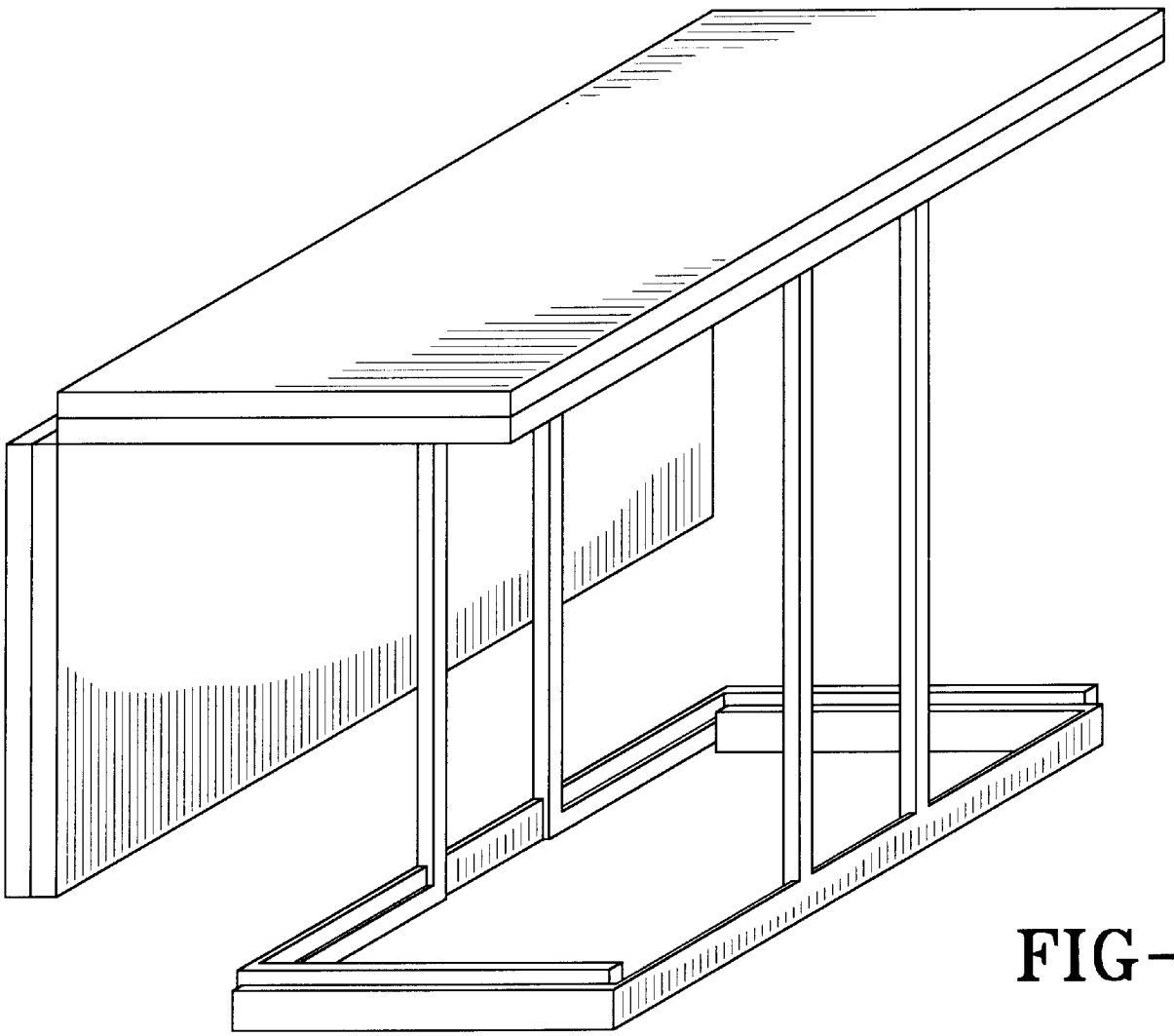
FIG. 15 is a perspective view of a table configuration in accordance with one embodiment of the present invention.

FIG. 15 is a perspective view of the table of the present invention in an alternative configuration (as described in FIG. 8) wherein the top of the table is in a configuration wherein the top is formed from two of the leaves one atop the other, while two leaves one aside the other, distend from one side edge thereof; and wherein the base is formed from the two base portions being in a nested configuration and forming a base of a relatively tall height.

Figure 15B:
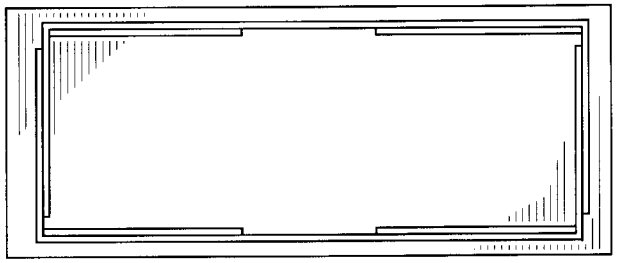
FIG. 15*b* is a bottom plan view of the table of FIG. 15.
Figure 15E:
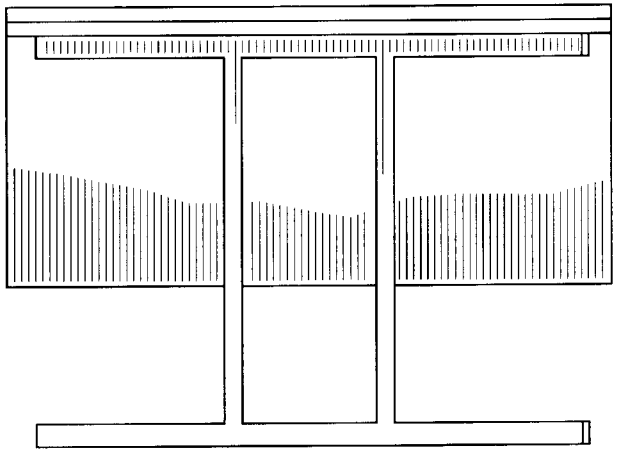
FIG. 15*e* is a back view of the table of FIG. 15.
Figure 15C:
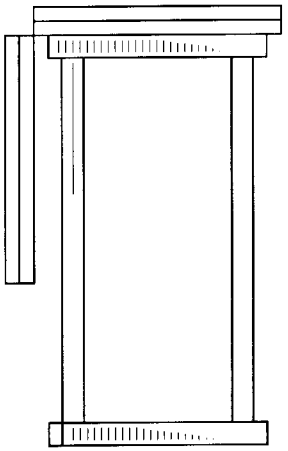
FIG. 15*c* is a side plan view of the table of FIG. 15.
Figure 15A:
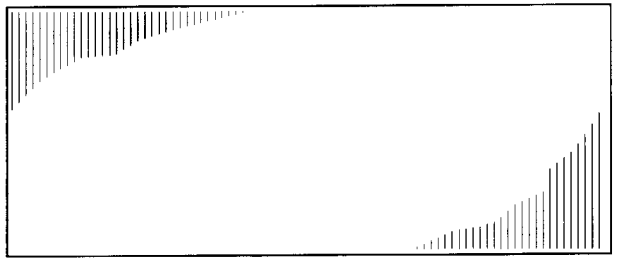
FIG. 15*a* is a top plan view of the table of FIG. 15.
Figure 15D:
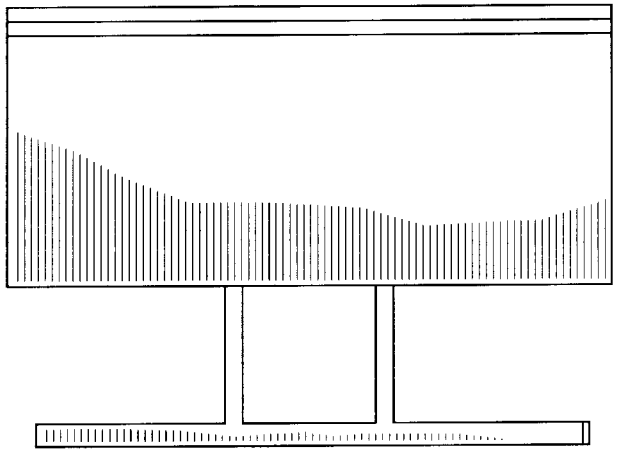
FIG. 15*d* is a front view of the table of FIG. 15.

FIG. 15*a* is a top plan view of the table of FIG. 15;

FIG. 15*b* is a bottom plan view of the table of FIG. 15;

FIG. 15*c* is a side plan view of the table of FIG. 15;

FIG. 15*d* is a front view of the table of FIG. 15; and

FIG. 15*e* is a back view of the table of FIG. 15.

Figure 16:
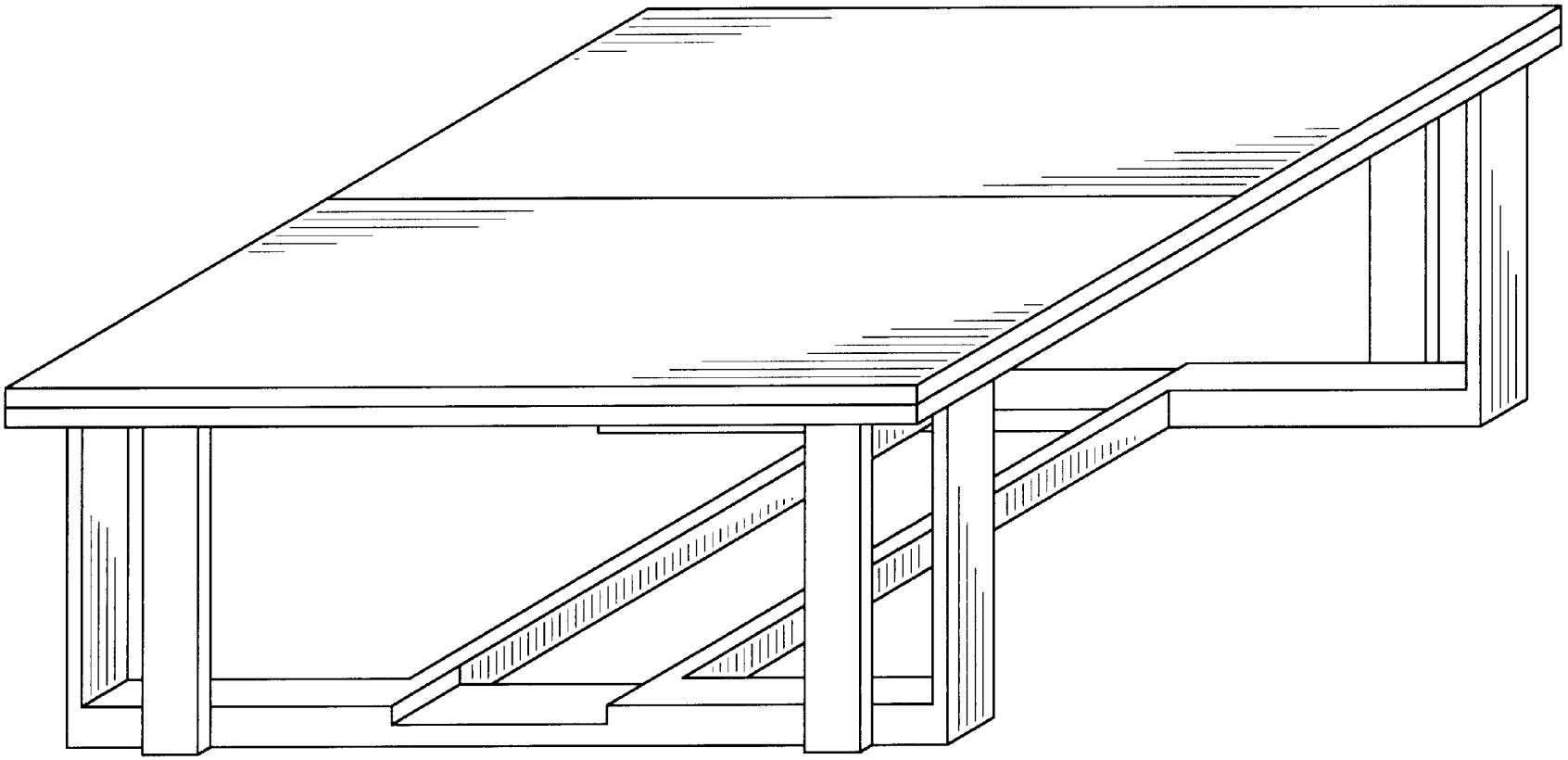
FIG. 16 is a perspective view of a table configuration in accordance with one embodiment of the present invention.

FIG. 16 is a perspective view of the table of the present invention in an alternative configuration (as described in FIG. 4) wherein the top of the table is in a configuration wherein the top is formed from the four leaves arranged in two pairs aside one another along their longest side, with each pair of leaves arranged one atop the other; and wherein the base is formed from the two base portions being in a configuration wherein the legs are in a nested configuration, and forming a base of a relatively short height.

Figure 16B:
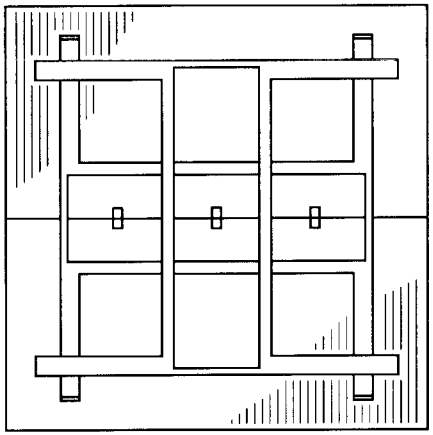
FIG. 16*b* is a top plan view of the table of FIG. 16.
Figure 16D:
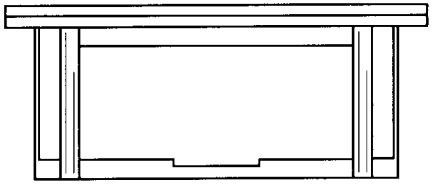
FIG. 16*d* is a side elevational view of the table of FIG. 16.
Figure 16A:
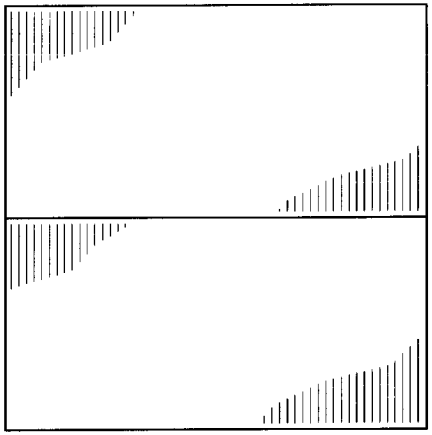
FIG. 16*a* is a bottom plan view of the table of FIG. 16.
Figure 16C:
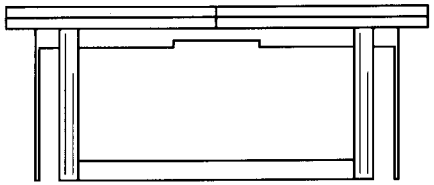
FIG. 16*c* is a front elevational view of the table of FIG. 16.

FIG. 16*a* is a bottom plan view of the table of FIG. 16;

FIG. 16*b* is a top plan view of the table of FIG. 16;

FIG. 16*c* is a front elevational view of the table of FIG. 16; and

FIG. 16*d* is a side elevational view of the table of FIG. 16.

Figure 17:
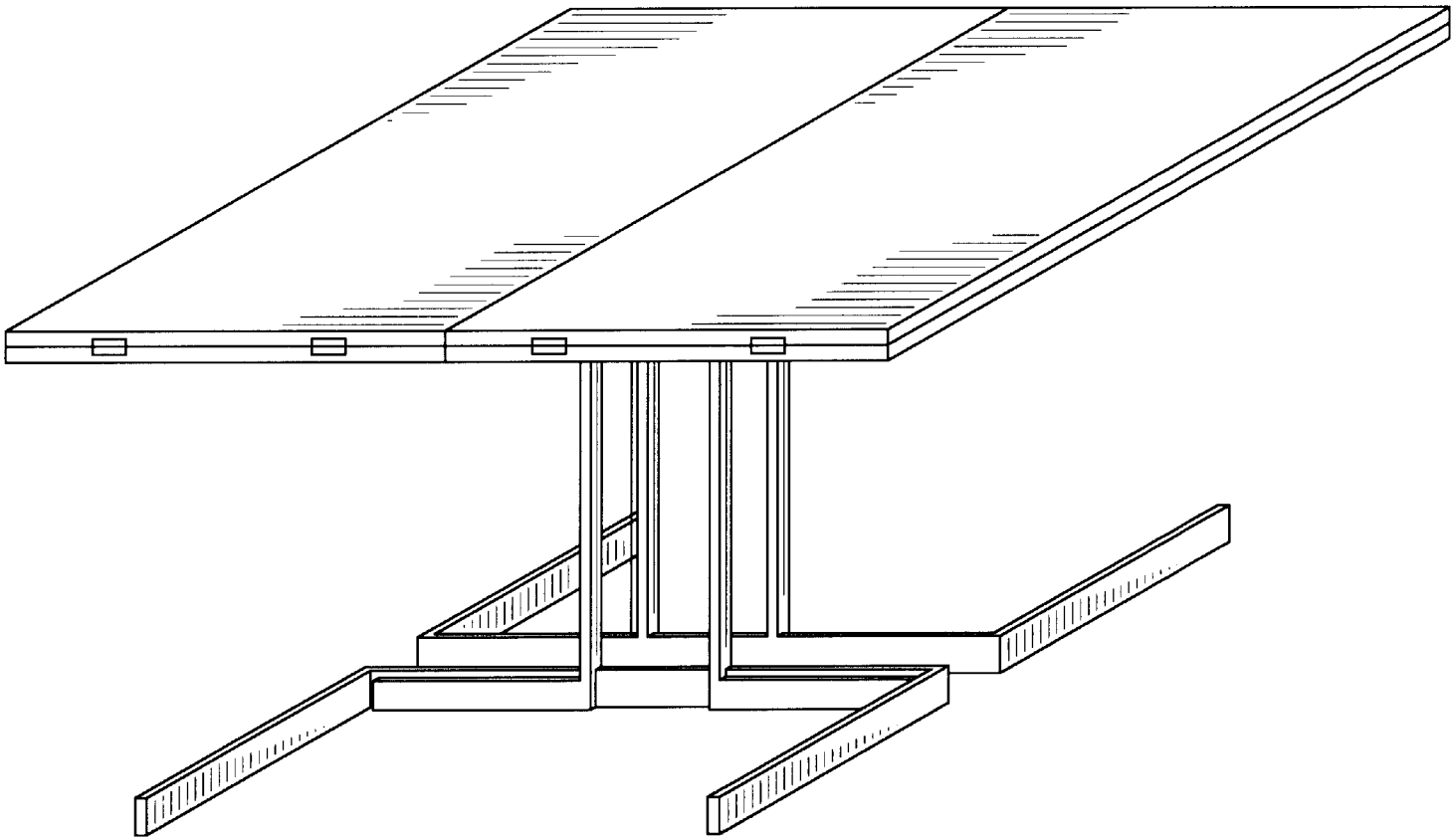
FIG. 17 is a perspective view of a table configuration in accordance with one embodiment of the present invention.

FIG. 17 is a perspective view of the table of the present invention in an alternative configuration (as described in FIG. 5) wherein the top of the table is in a configuration wherein the top is formed from the four leaves arranged in two pairs aside one another along their longest side, with each pair of leaves arranged one atop the other; and wherein the base is formed from the two base portions being in a configuration wherein the base portions are arranged on their side and adjacent to one another along their top sides, with the legs of each base portion facing away from one another, and forming a base of a relatively tall height.

Figure 17B:
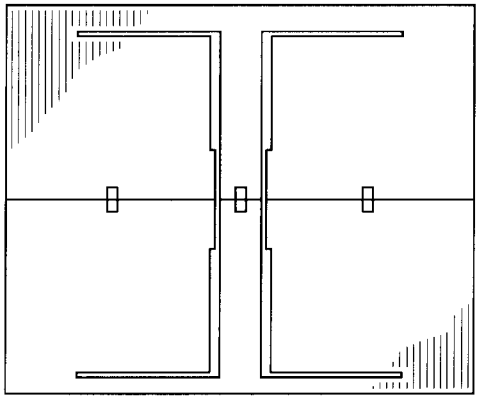
FIG. 17*b* is a bottom plan view of the table of FIG. 17.
Figure 17D:
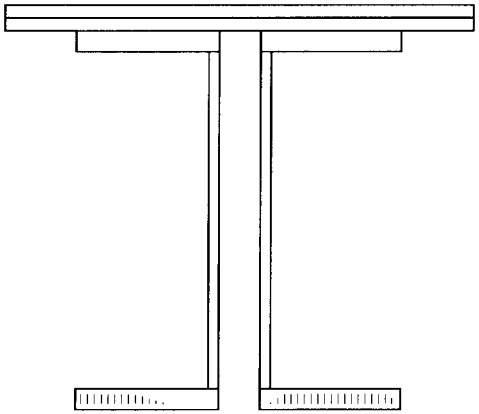
FIG. 17*d* is a front elevational view of the table of FIG. 17.
Figure 17A:
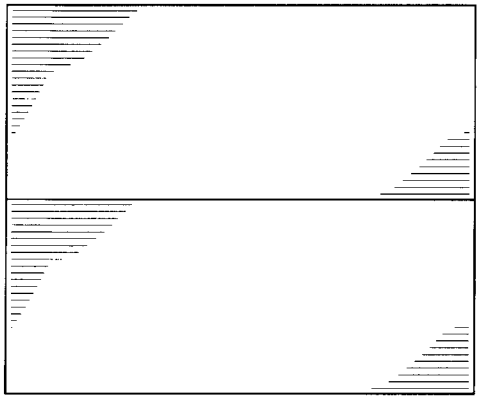
FIG. 17*a* is a top plan view of the table of FIG. 17.
Figure 17C:
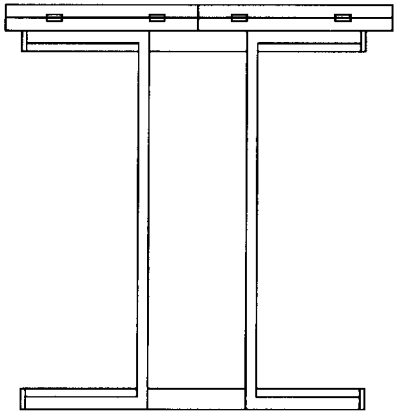
FIG. 17*c* is a side elevational view of the table of FIG. 17.

FIG. 17*a* is a top plan view of the table of FIG. 17;

FIG. 17*b* is a bottom plan view of the table of FIG. 17;

FIG. 17*c* is a side elevational view of the table of FIG. 17; and

FIG. 17*d* is a front elevational view of the table of FIG. 17.

Figure 18:
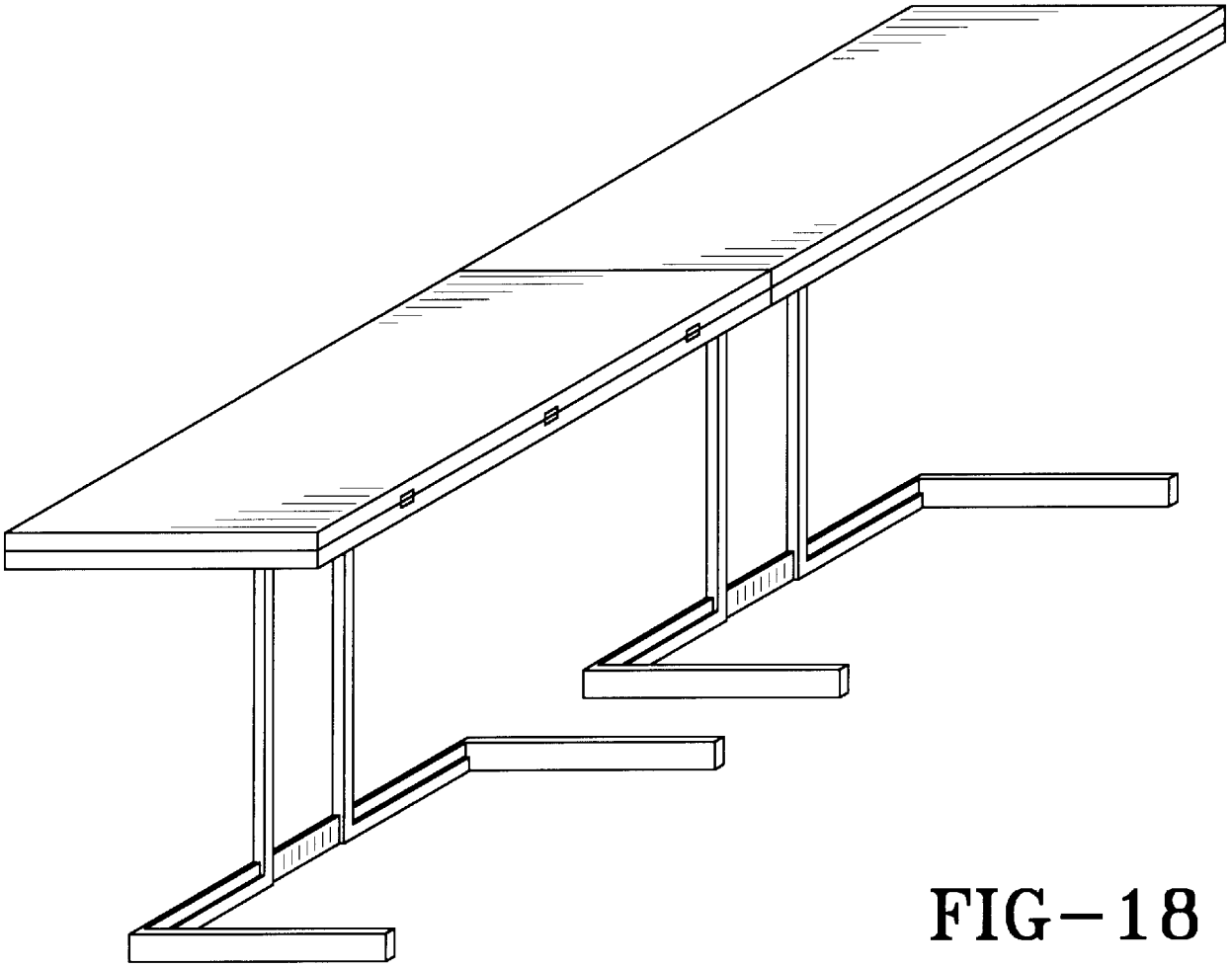
FIG. 18 is a perspective view of a table configuration in accordance with one embodiment of the present invention.

FIG. 18 is a perspective view of the table of the present invention in an alternative configuration (as described in FIG. 6) wherein the top of the table is in a configuration wherein the top is formed from the four leaves arranged in two pairs aside one another along their shortest side, with each pair of leaves arranged one atop the other; and wherein the base is formed from the two base portions being in a configuration wherein the base portions are arranged on their side and adjacent to one another along their lateral sides, with the legs of each base portion facing in the same direction, and forming a base of a relatively tall height.

Figure 18B:
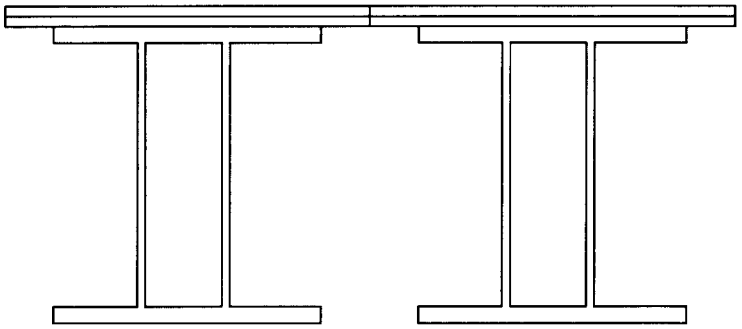
FIG. 18*b* is a rear side elevational view of the table of FIG. 18.
Figure 18C:
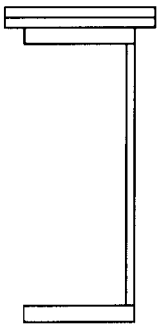
FIG. 18*c* is a side elevational view of the table of FIG. 18.
Figure 18E:
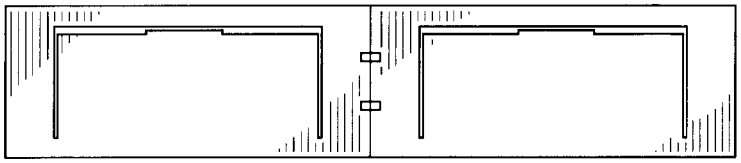
FIG. 18*e* is a bottom plan view of the table of FIG. 18.
Figure 18A:
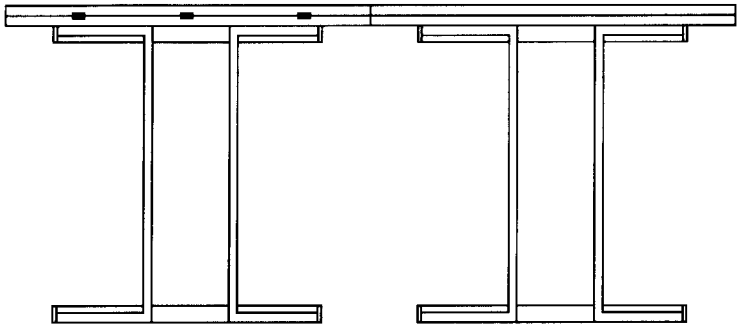
FIG. 18*a* is a front side elevational view of the table of FIG. 18.
Figure 18D:
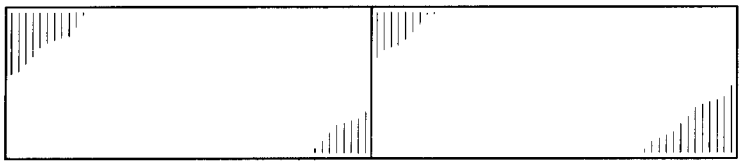
FIG. 18*d* is a top plan view of the table of FIG. 18.

FIG. 18*a* is a front side elevational view of the table of FIG. 18;

FIG. 18*b* is a rear side elevational view of the table of FIG. 18;

FIG. 18*c* is a side elevational view of the table of FIG. 18;

FIG. 18*d* is a top plan view of the table of FIG. 18; and

FIG. 18*e* is a bottom plan view of the table of FIG. 18.

Figure 19:
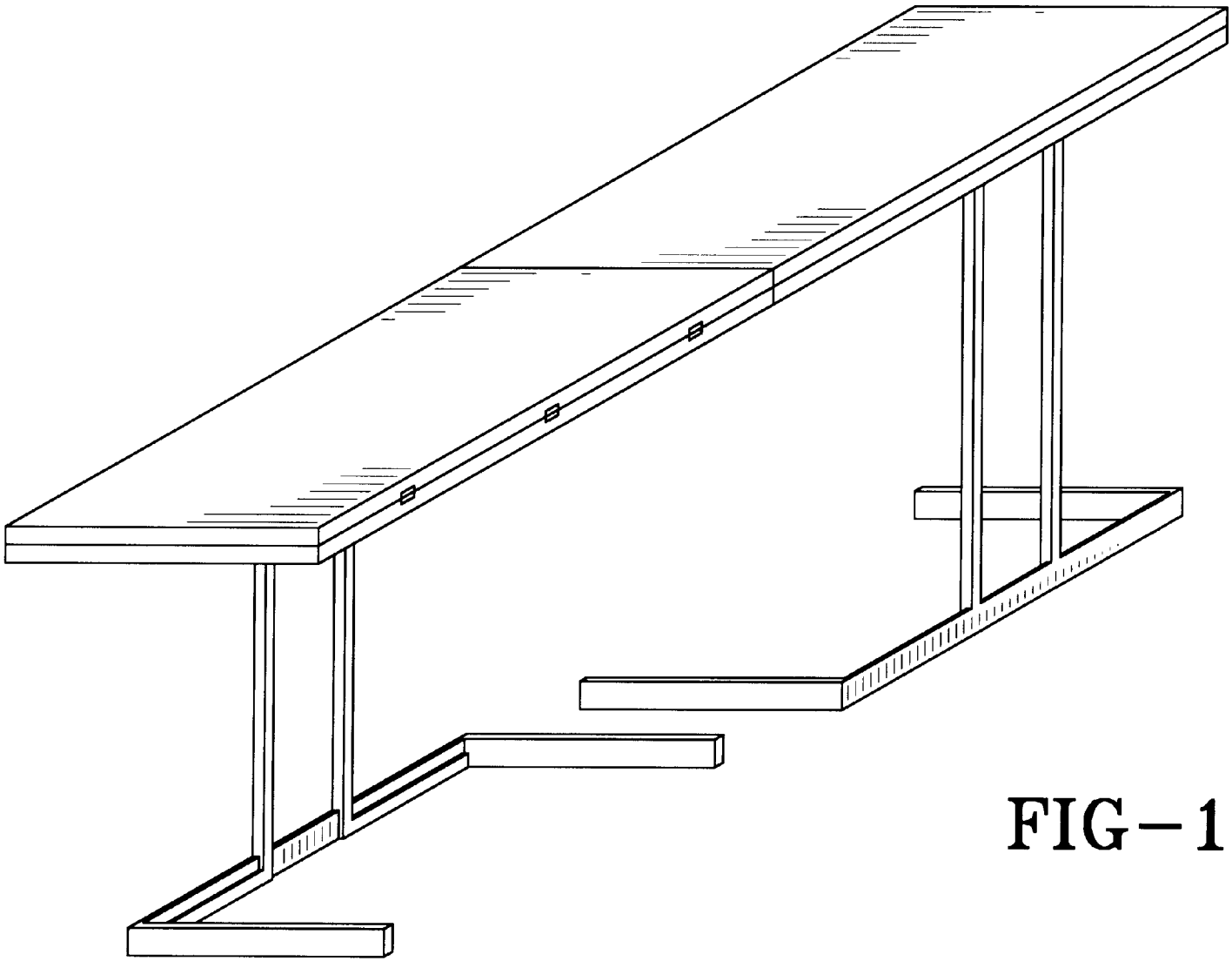
FIG. 19 is a perspective view of a table configuration in accordance with one embodiment of the present invention.

FIG. 19 is a perspective view of the table of the present invention in an alternative configuration (as described in FIG. 9) wherein the top of the table is in a configuration wherein the top is formed from the four leaves arranged in two pairs aside one another along their shortest side, with each pair of leaves arranged one atop the other; and wherein the base is formed from the two base portions being in a configuration wherein the base portions are arranged on their side and adjacent to one another along their lateral sides, with the legs of each base portion facing in opposite directions, and forming a base of a relatively tall height.

Figure 19B:
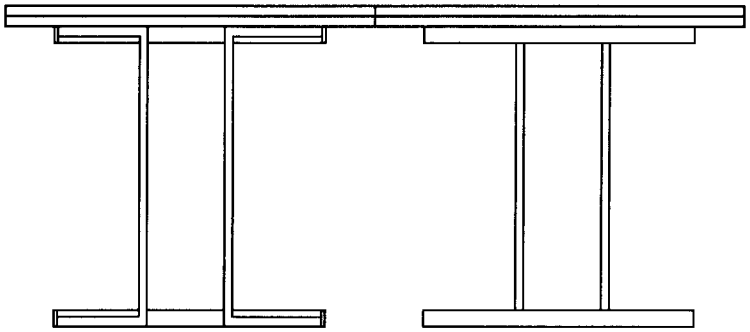
FIG. 19*b* is a second side elevational view of the table of FIG. 19.
Figure 19C:
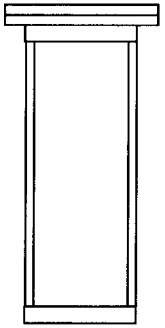
FIG. 19*c* is a third side elevational view of the table of FIG. 19.
Figure 19E:
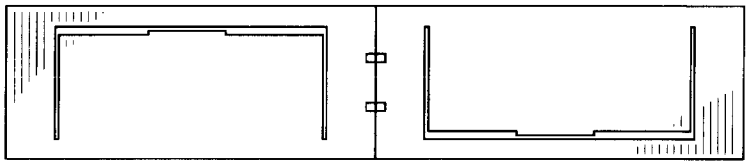
FIG. 19*e* is a bottom plan view of the table of FIG. 19.
Figure 19A:
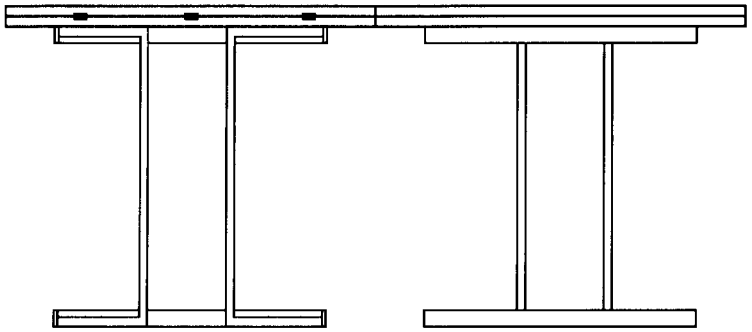
FIG. 19*a* is a first side elevational view of the table of FIG. 19.
Figure 19D:
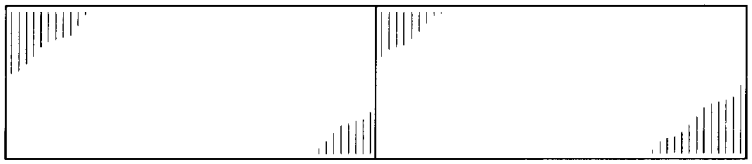
FIG. 19*d* is a top plan view of the table of FIG. 19.

FIG. 19*a* is a first side elevational view of the table of FIG. 19;

FIG. 19*b* is a second side elevational view of the table of FIG. 19;

FIG. 19*c* is a third side elevational view of the table of FIG. 19;

FIG. 19*d* is a top bottom plan view of the table of FIG. 19; and

FIG. 19*e* is a bottom plan view of the table of FIG. 19.

Figure 20:
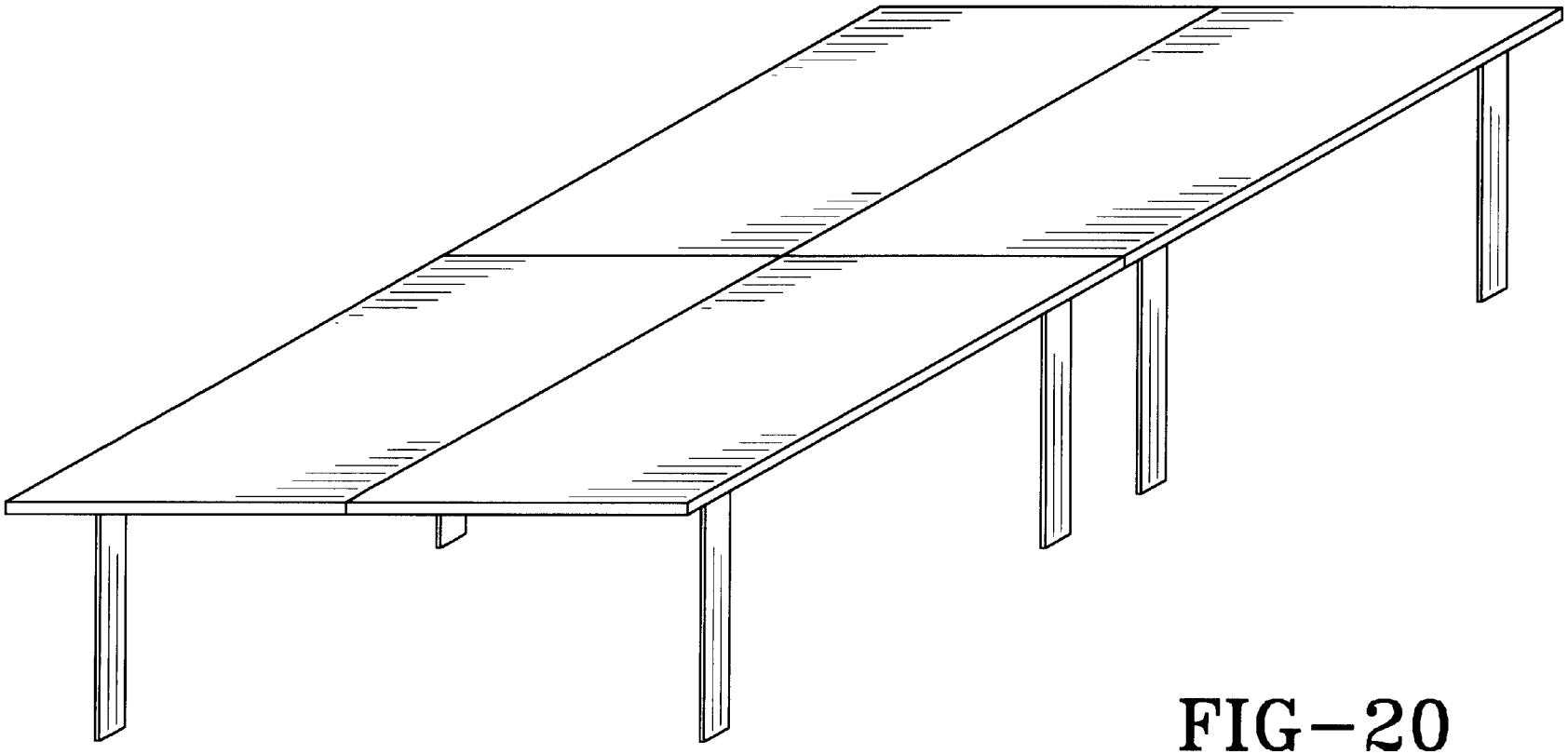
FIG. 20 is a perspective view of a table configuration in accordance with one embodiment of the present invention.

FIG. 20 is a perspective view of the table of the present invention in an alternative configuration (as described in FIG. 10) wherein the top of the table is in a configuration wherein the top is formed from all four leaves arranged in a coplanar configuration; and wherein the base is formed from the two base portions being in a configuration wherein the base portions are arranged so as to stand on their legs, and adjacent to one another along their lateral sides, and forming a base of a relatively short height.

Figure 20B:
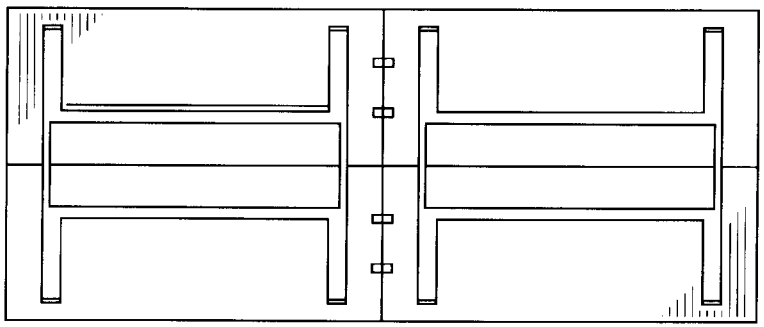
FIG. 20*b* is a bottom plan view of the table of FIG. 20.
Figure 20D:
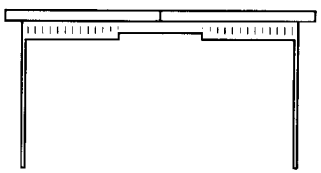
FIG. 20*d* is a side elevational view of the table of FIG. 20.
Figure 20A:
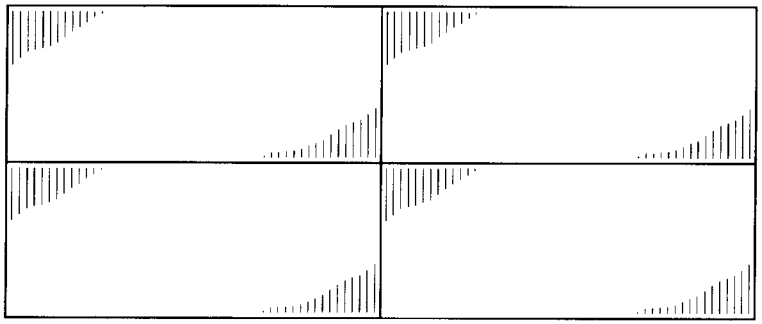
FIG. 20*a* is a top plan view of the table of FIG. 20.
Figure 20C:
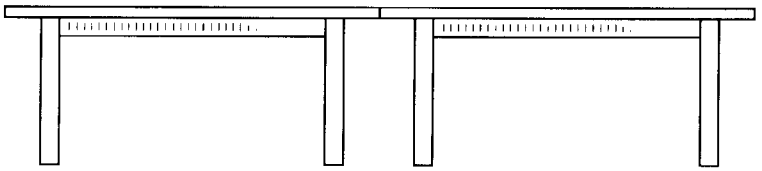
FIG. 20*c* is a front elevational view of the table of FIG. 20.

FIG. 20*a* is a top plan view of the table of FIG. 20;

FIG. 20*b* is a bottom plan view of the table of FIG. 20;

FIG. 20*c* is a front elevational view of the table of FIG. 20; and

FIG. 20*d* is a side elevational view of the table of FIG. 20.

Figure 21:
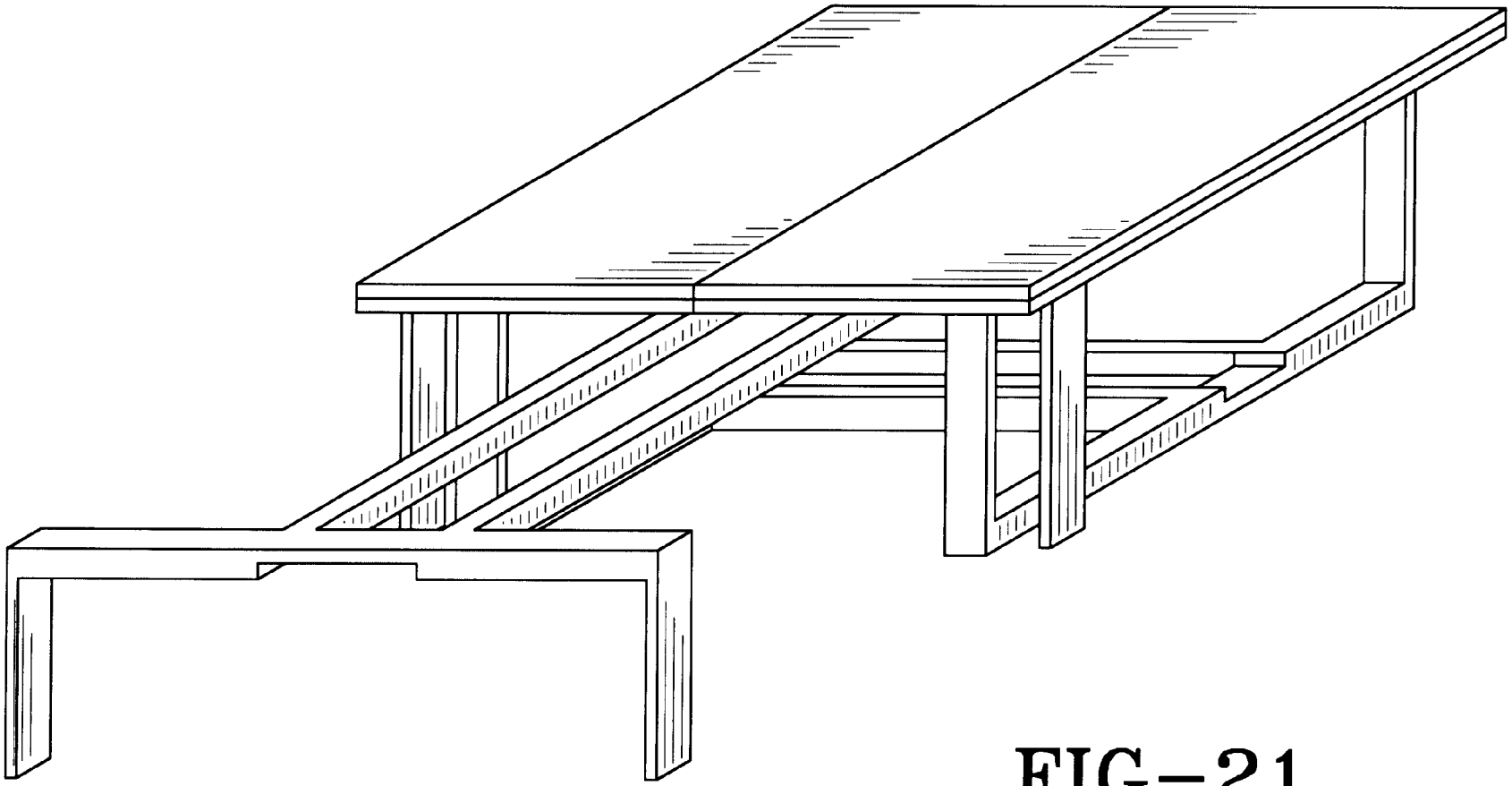
FIG. 21 is a perspective view of a table configuration in accordance with one embodiment of the present invention.

FIG. 21 is a perspective view of the table of the present invention in an alternative configuration (as described in FIG. 12) wherein the top of the table is in a configuration wherein the top is formed from the four leaves arranged in two pairs aside one another along their longest side, with each pair of leaves arranged one atop the other; and wherein the base is formed from the two base portions being in a configuration wherein the legs are in a partially nested configuration, with a first base portion set upon its top such that its legs support the top, and the other base portion set upon it legs and extending from under the top and having its cross members arranged perpendicular to the cross members of the first base portion, and forming a base of a relatively short height.

Figure 21B:
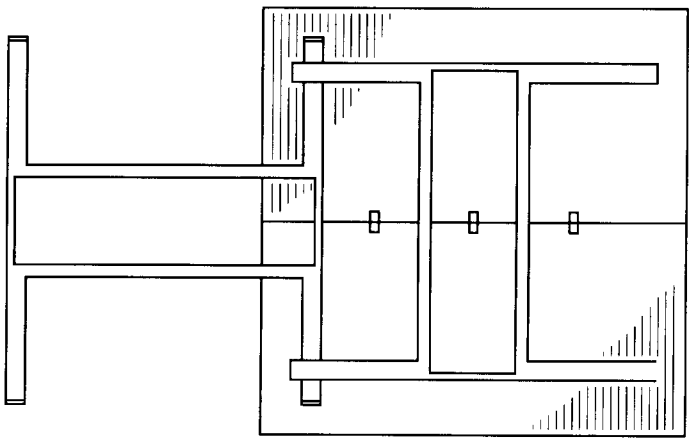
FIG. 21*b* is a bottom plan view of the table of FIG. 21.
Figure 21D:
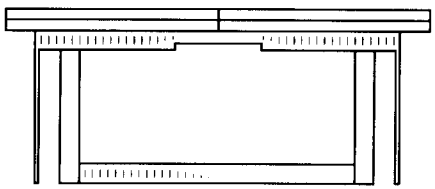
FIG. 21*d* is a side elevational view of the table of FIG. 21.
Figure 21A:
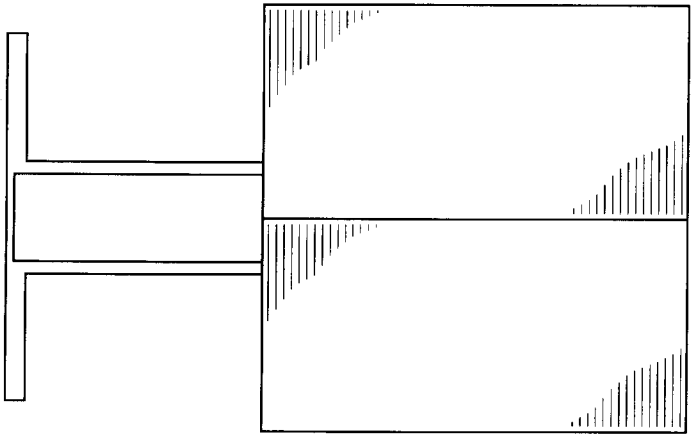
FIG. 21*a* is a top plan view of the table of FIG. 21.
Figure 21C:
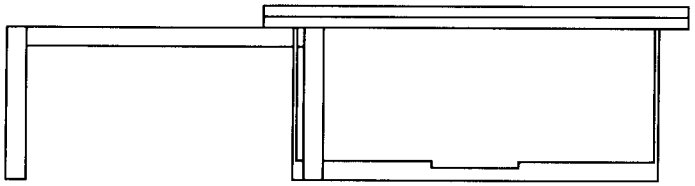
FIG. 21*c* is a front elevational view of the table of FIG. 21.

FIG. 21*a* is a bottom plan view of the table of FIG. 21;

FIG. 21*b* is a top plan view of the table of FIG. 21;

FIG. 21*c* is a front elevational view of the table of FIG. 21; and

FIG. 21*d* is a side elevational view of the table of FIG. 21.

Figure 22:
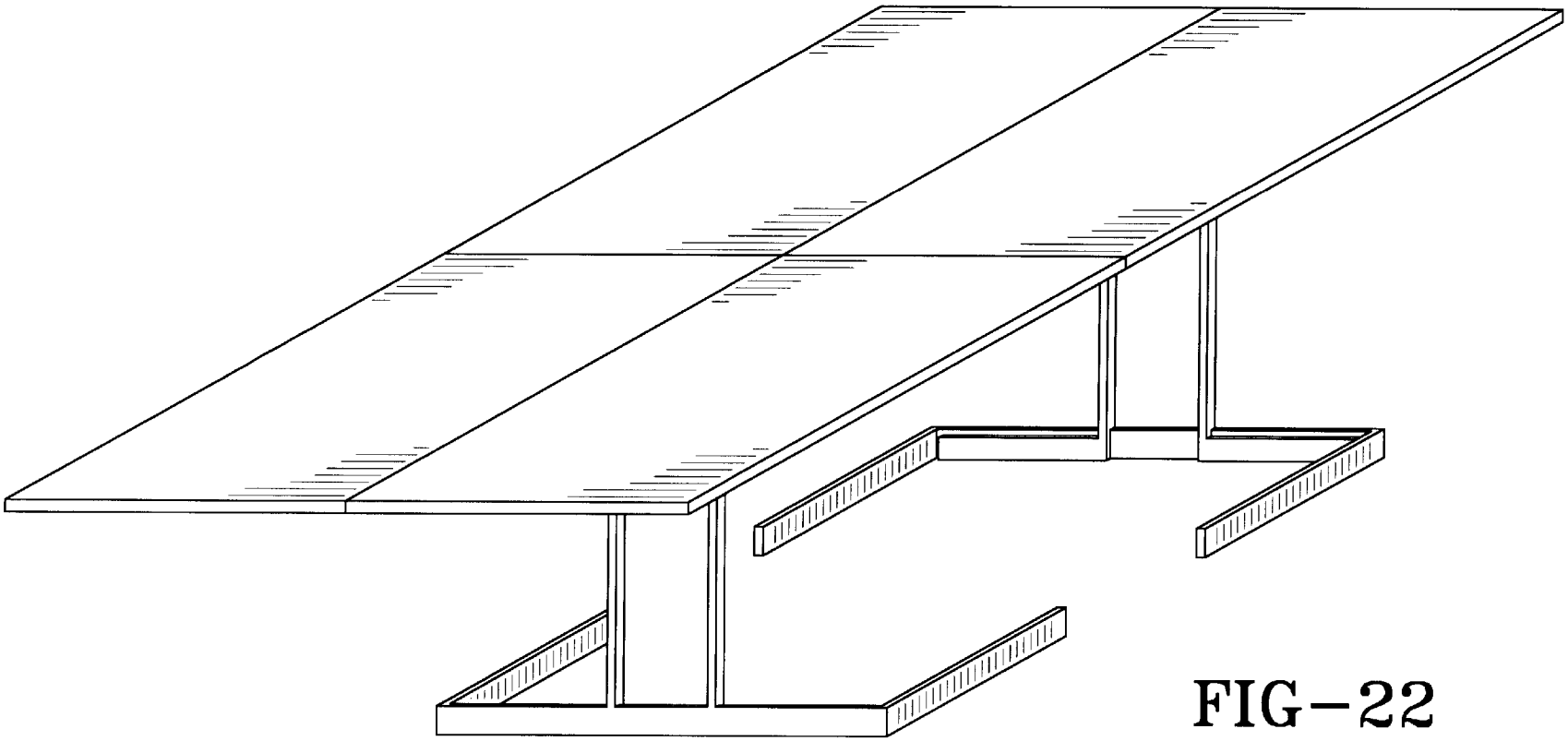
FIG. 22 is a perspective view of a table configuration in accordance with one embodiment of the present invention.

FIG. 22 is a perspective view of the table of the present invention in an alternative configuration (as described in FIGS. 11, 11*a* and 11*b*) wherein the top of the table is in a configuration wherein the top is formed from all four leaves arranged in a coplanar configuration; and wherein the base is formed from the two base portions being in a configuration wherein the base portions are arranged on their side and adjacent to one another along their top sides and adjoined by a bridge member, with the legs of each base portion facing one another, and forming a base of a relatively tall height.

Figure 22A:
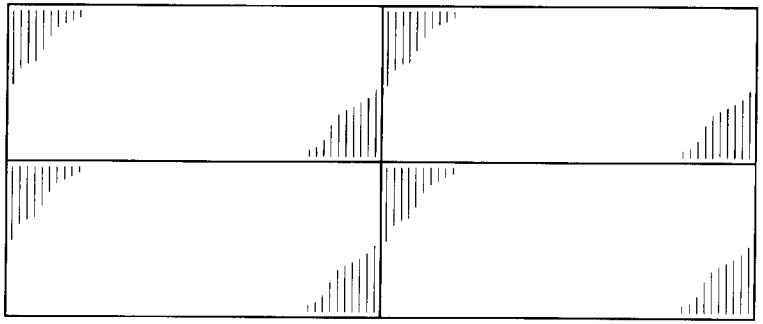
FIG. 22*a* is a top plan view of the table of FIG. 22.
Figure 22B:
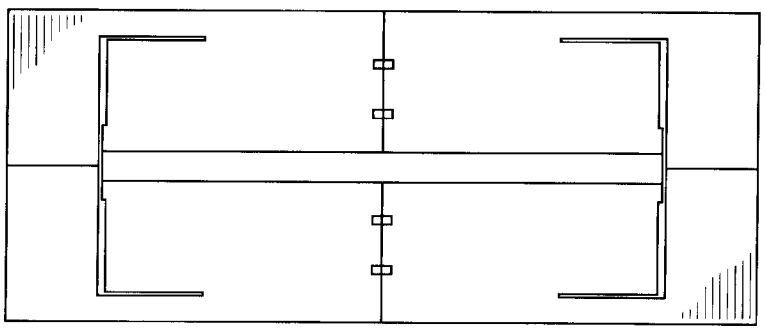
FIG. 22*b* is a bottom plan view of the table of FIG. 22.
Figure 22C:
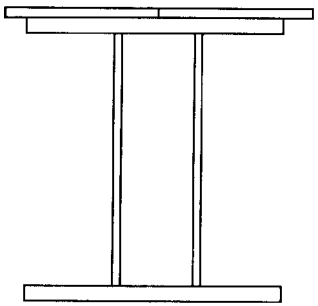
FIG. 22*c* is a front elevational view of the table of FIG. 22.

FIG. 22*a* is a top plan view of the table of FIG. 22;

FIG. 22*b* is a bottom plan view of the table of FIG. 22;

FIG. 22*c* is a front elevational view of the table of FIG. 22; and

Figure 22D:
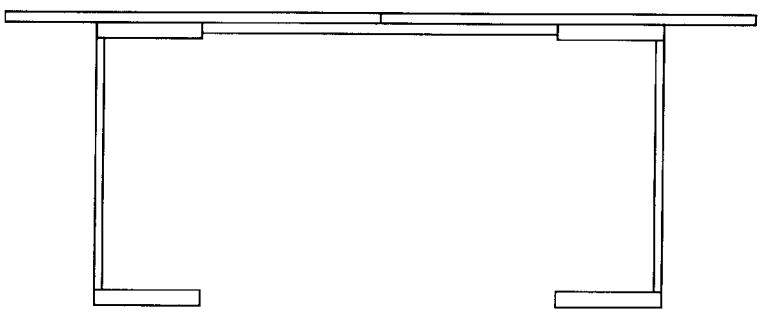
FIG. 22*d* is a side elevational view of the table of FIG. 22.

FIG. 22*d* is a side elevational view of the table of FIG. 22.

Figure 23:
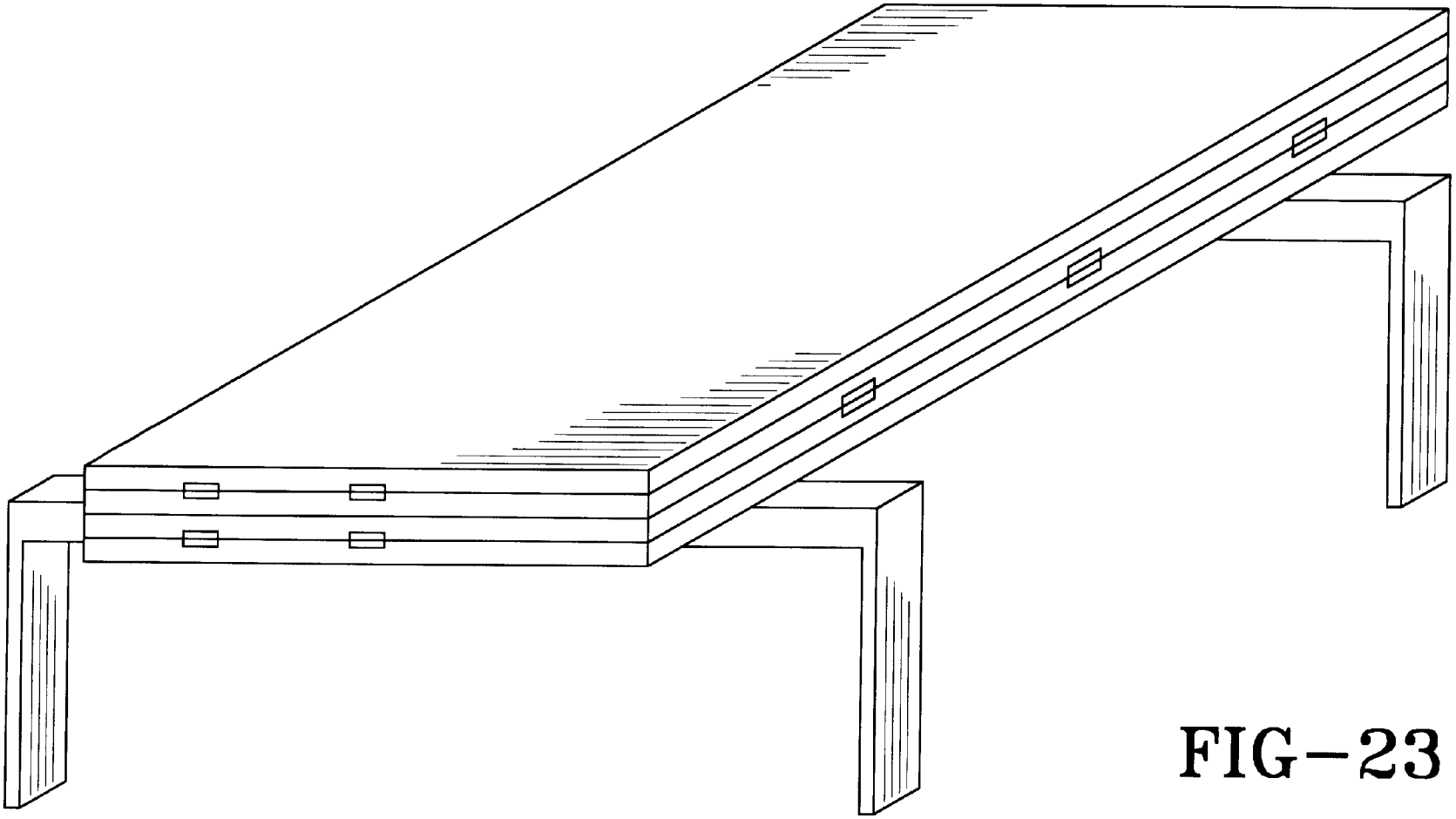
FIG. 23 is a perspective view of a table configuration in accordance with one embodiment of the present invention.

FIG. 23 is a perspective view of the table of the present invention in an alternative configuration (not described in the foregoing Figures) wherein the top of the table is in a configuration wherein the top is formed from all four of the leaves are arranged atop one another; and wherein the base is formed from only one of the base portions, the base portion resting on its legs. In this configuration the table top is centered upon only one of the base portions with the longitudinal axis of the top oriented parallel to the cross members. Such a configuration forms a supporting base portion of approximately 30 inches by 28 inches. This configuration gives an overall total height of approximately 17 inches. This configuration may be used as a coffee table.

Figure 23A:
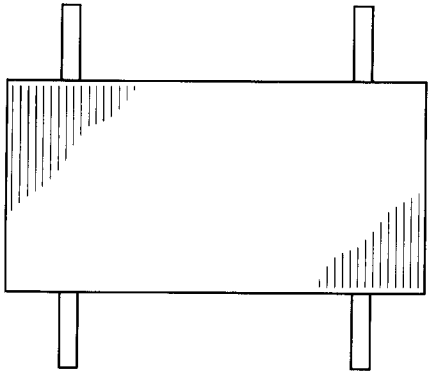
FIG. 23*a* is a top plan view of the table of FIG. 23.
Figure 23B:
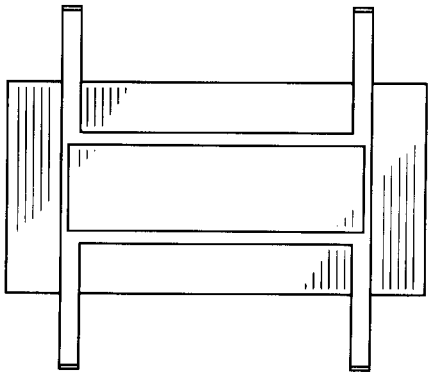
FIG. 23*b* is a bottom plan view of the table of FIG. 23.
Figure 23C:
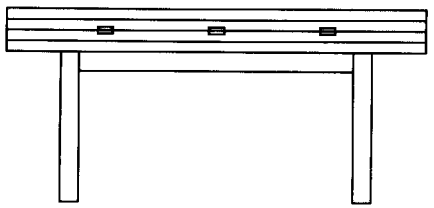
FIG. 23*c* is a front elevational view of the table of FIG. 23.

FIG. 23*a* is a top plan view of the table of FIG. 23;

FIG. 23*b* is a bottom plan view of the table of FIG. 23;

FIG. 23*c* is a front elevational view of the table of FIG. 23; and

Figure 23D:
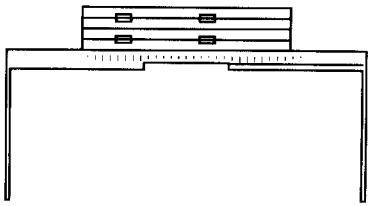
FIG. 23*d* is a side elevational view of the table of FIG. 23.

FIG. 23*d* is a side elevational view of the table of FIG. 23.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, it will be within the ability of one of ordinary skill in the art to make alterations or modifications to the present invention, such as through the substitution of equivalent materials or structural arrangements, so as to be able to practice the present invention without departing from its spirit as reflected in the appended claims. It is the intention, therefore, to limit the invention only as indicated by the scope of the claims.

What is claimed is:

1. A table capable of being configured into at least three surface area sizes and two heights, said table comprising:

(a) a table top comprising four hingedly connected leaves of approximately equal surface area, which may be folded with respect to one another so as to form table top configurations of: (1) the surface area of one of said leaves, (2) the surface area of two of said leaves, and (3) the surface area of all four of said leaves;

(b) a base comprising first and second base portions unattached to said table top, said first and second base portions adapted to be arranged in first, second and third configurations, said first configuration adapted to support said table top when said four leaves are in said table top configuration of the surface area of one of said leaves, said second configuration adapted to support said table top when said four leaves are in said table top configuration of the surface area of two of said leaves, and said third configuration adapted to support said table top when said four leaves are in said table top configuration of the surface area of all four of said leaves, and wherein two of said first, second and third configurations vary in height.

2. A table according to claim 1 wherein said first and second base portions are adapted to be arranged in a nested configuration and an adjacent configuration.

3. A table according to claim 1 wherein said first and second base portions are adapted to be arranged in a first nested configuration of a first height, a first adjacent, non-nested configuration at said first height, a second nested configuration of a second height, and a second adjacent, non-nested configuration at said second height.

4. A table according to claim 3 wherein said first and second base portions are identical and each comprises a frame adapted to contact and support a flat surface, and each base portion having four straight legs on one side thereof.

5. A table according to claim 4 wherein said first and second base portions are adapted to form first and second nested configurations by the straight legs of each portion nesting toward one another.

6. A table according to claim 1 wherein said table top surface area of said second configuration is formed by a first set of two of said leaves, the remaining two leaves distending from said first set of two of said leaves.

7. A table according to claim 1 wherein said four leaves are movably attached to one another by flush mount hinges.

8. A table according to claim 1 wherein said first and second base portions are connected by a bridging piece when said first and second portions are in said third configuration.

* * * * *